US011315460B1

(12) United States Patent
Xue et al.

(10) Patent No.: US 11,315,460 B1
(45) Date of Patent: Apr. 26, 2022

(54) GATE ELECTRODE DRIVING CIRCUIT AND DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventors: Yan Xue, Shenzhen (CN); Xian Wang, Shenzhen (CN)

( * ) Notice: Subject to any disclaimer, the term of this patent is extended or adjusted under 35 U.S.C. 154(b) by 219 days.

(21) Appl. No.: 16/772,818

(22) PCT Filed: Apr. 10, 2020

(86) PCT No.: PCT/CN2020/084134
§ 371 (c)(1),
(2) Date: Jun. 15, 2020

(87) PCT Pub. No.: WO2021/168999
PCT Pub. Date: Sep. 2, 2021

(30) Foreign Application Priority Data

Feb. 26, 2020 (CN) ..... 202010121162.6

(51) Int. Cl.
*G09G 3/20* (2006.01)

(52) U.S. Cl.
CPC ..... *G09G 3/20* (2013.01); *G09G 2300/0426* (2013.01); *G09G 2300/0842* (2013.01); *G09G 2310/0267* (2013.01); *G09G 2310/08* (2013.01)

(58) Field of Classification Search
CPC ..... G09G 3/3266; G09G 3/3677; G09G 2310/0286; G09G 2300/0408
See application file for complete search history.

(56) References Cited

U.S. PATENT DOCUMENTS

2016/0253975 A1 9/2016 Yang et al.
2018/0337682 A1* 11/2018 Takasugi ..... H03K 21/18
2021/0056908 A1* 2/2021 Park ..... G09G 3/3275
2021/0209987 A1* 7/2021 Feng ..... G09G 3/20

FOREIGN PATENT DOCUMENTS

CN 105139316 A 12/2015
CN 110111743 A 8/2019
CN 110570800 A 12/2019

* cited by examiner

*Primary Examiner* — Sepehr Azari

(57) ABSTRACT

A gate electrode driving circuit and a display panel are provided. By disposing a low frequency control signal source and a third drop-down unit, the gate electrode driving circuit makes the low frequency control signal source and the third drop-down unit replace one group of clock signal. Furthermore, because the low frequency control signal source and the third drop-down unit occupy less space, a width of the gate electrode driving circuit is reduced, thereby reducing a bezel of the display panel.

20 Claims, 8 Drawing Sheets

GATE ELECTRODE DRIVING CIRCUIT AND DISPLAY PANEL

FIELD OF INVENTION

The present disclosure relates to the field of display technology, and particularly relates to a gate electrode driving circuit and a display panel.

BACKGROUND OF INVENTION

In order to reduce a number of external chips of current display panels, gate driver on array (GOA) circuits are used to replace the external chips. However, in a GOA circuit, threshold voltages of transistors need to be compensated to make a display screen better. As illustrated in FIG. 1, in a current GOA circuit for threshold voltage compensation of the transistors, it is necessary to use three different clock signals to drive circuits or to perform stage transfer. However, in order to lower impedance of clock signal lines, each group of the clock signal lines includes twelve clock signal lines, as illustrated in FIG. 2. This will cause more clock signal lines, resulting in larger bezels of the display panels and inability to realize narrow bezels.

Therefore, a technical problem that a large number of the clock signal lines results in the larger bezels of the display panels exists in the current GOA circuits.

SUMMARY OF INVENTION

Embodiments of the present disclosure provide a gate electrode driving circuit and a display panel used for easing the technical problem of a large number of the clock signal lines causing the larger bezels of the display panels.

In order to solve the problems mentioned above, the present disclosure provides the technical solutions as follows:

An embodiment of the present disclosure provides a gate electrode driving circuit, including:

a logical addressing unit connected to a first node to pull up electric potentials of the first node and a second node in a plurality of blank time periods;

a pull-up control module connected to the logical addressing unit and the first node and used for pulling up the electric potential of the first node at a plurality of display time periods;

a pull-up unit including the first node, a second node, and a low frequency control signal source, wherein the pull-up unit is connected to the pull-up control module and is used for pulling up electric potentials of a first stage transfer signal, a first output signal, and a second output signal;

a first drop-down unit connected to the first node and used for dropping down the electric potential of the first node at an end of the plurality of blank time periods;

a second drop-down unit connected to the first node and used for dropping down the electric potential of the first node at the plurality of display time periods;

a third drop-down unit connected to the second node and used for dropping down the electric potential of the second node at the plurality of display time periods;

a fourth drop-down unit connected to a third node and used for dropping down an electric potential of the third node at a start of the plurality of display time periods;

a first drop-down maintaining unit connected to the first node and used for maintaining a low electric potential of the first node;

a second drop-down maintaining unit used for maintaining low electric potentials of the first stage transfer signal, the first output signal, and the second output signal; and an inverter including the third node used for inverting the electric potentials of the first node and the third node.

In some embodiments, the logical addressing unit includes a second stage transfer signal terminal, a first signal input terminal, a high electric potential input terminal, a reset signal terminal, a first transistor, a second transistor, a third transistor, a fourth transistor, a fifth transistor, and a first storage capacitor. A gate electrode of the first transistor is connected to the first signal input terminal. A first electrode of the first transistor is connected to the second stage transfer signal terminal. A second electrode of the first transistor is connected to a first electrode of the second transistor. The second electrode of the first transistor is connected to a second electrode of the third transistor. A gate electrode of the second electrode is connected to the first signal input terminal. A second electrode of the second transistor is connected to a first polar plate of the first storage capacitor. A first electrode of the third transistor is connected to the high electric potential input terminal. A gate electrode of the third transistor is connected to the first polar plate of the first storage capacitor. The high electric potential input terminal is connected to a second polar plate of the first storage capacitor. A gate electrode of the fourth transistor is connected to the first polar plate of the first storage capacitor. A first electrode of the fourth transistor is connected to the high electric potential input terminal. A second electrode of the fourth transistor is connected to a first electrode of the fifth transistor. A gate electrode of the fifth transistor is connected to the reset signal terminal. A second electrode of the fifth transistor is connected to the first node.

In some embodiments, the pull-up control module includes the second stage transfer signal terminal, a fourth node, a sixth transistor, a seventh transistor. A gate electrode and a first electrode of the sixth transistor are connected to the second stage transfer signal terminal. A second electrode of the sixth transistor is connected to the fourth node. A gate electrode of the seventh transistor is connected to the second stage transfer signal terminal. A first electrode of the seventh transistor is connected to the fourth node. A second electrode of the seventh transistor is connected to the first node.

In some embodiments, a first stage transfer signal terminal, a first signal output terminal, and a second signal output terminal are further included, and the pull-up unit includes a first clock signal terminal, a second clock signal terminal, the fourth node, a second storage capacitor, a third storage capacitor, an eighth transistor, a ninth transistor, a tenth transistor, an eleventh transistor, and a twelfth transistor. A gate electrode of the eighth transistor is connected to the first clock signal terminal. A first electrode of the eighth transistor is connected to the first node. A second electrode of the eighth transistor is connected to a gate electrode of the ninth transistor. A first electrode of the ninth transistor is connected to the low frequency control signal source. A second electrode of the ninth transistor is connected to the first stage transfer signal terminal. A gate electrode of the tenth transistor is connected to the second node. A first electrode of the tenth transistor is connected to the first clock signal terminal. A second electrode of the tenth transistor is connected to the first signal output terminal. A gate electrode of the eleventh transistor is connected to the second node. A first electrode of the eleventh transistor is connected to the second clock signal terminal. A second electrode of the eleventh transistor is connected to the second signal output terminal. A gate electrode of the twelfth transistor is connected to the second node. A first electrode of the twelfth transistor is connected to the fourth node. A second electrode of the twelfth transistor is connected to the first signal output terminal. A first polar plate of the second storage capacitor is connected to the second node. A second polar plate of the second storage capacitor is connected to the first signal output terminal. A first polar plate of the third storage capacitor is connected to the second node. A second polar plate of the third storage capacitor is connected to the second signal output terminal.

In some embodiments, the first drop-down unit includes a first low electric potential input terminal, a second signal input terminal, a thirteenth transistor, and a fourteenth transistor. A gate electrode of the thirteenth transistor is connected to the second signal input terminal. A first electrode of the thirteenth transistor is connected to a second electrode of the fourteenth transistor. A second electrode of the thirteenth transistor is connected to the first node. A gate electrode of the fourteenth transistor is connected to the second signal input terminal. A first electrode of the fourteenth transistor is connected to the first low electric potential input terminal.

In some embodiments, the second drop-down unit includes a third stage transfer signal terminal, the fourth node, a fifteenth transistor, and a sixteenth transistor. A gate electrode of the fifteenth transistor is connected to the third stage transfer signal terminal. A first electrode of the fifteenth transistor is connected to the fourth node. A second electrode of the fifth transistor is connected to the first node. A gate electrode of the sixteenth transistor is connected to the third stage transfer signal terminal. A first electrode of the sixteenth transistor is connected to the first low electric potential input terminal. A second electrode of the sixteenth transistor is connected to the fourth node.

In some embodiments, the third drop-down unit includes the third stage transfer signal terminal, the fourth node, a seventeenth transistor, and an eighteenth transistor. A gate electrode of the seventeenth transistor is connected to the third stage transfer signal terminal. A first electrode of the seventeenth transistor is connected to the fourth node. A second electrode of the seventeenth transistor is connected to the second node. A gate electrode of the eighteenth transistor is connected to the third stage transfer signal terminal. A first electrode of the eighteenth transistor is connected to the first low electric potential input terminal. A second electrode of the eighteenth transistor is connected to the fourth node.

In some embodiments, the fourth drop-down unit includes the first stage transfer signal terminal, the reset signal terminal, a fifth node, a nineteenth transistor, a twentieth transistor, and a twenty-first transistor. A gate electrode of the nineteenth transistor is connected to the first stage transfer signal terminal. A first electrode of the nineteenth transistor is connected to a second low electric potential input terminal. A second electrode of the nineteenth transistor is connected to the third node. A gate electrode of the twentieth transistor is connected to the reset signal terminal. A first electrode of the twentieth transistor is connected to a second electrode of the twenty-first transistor. A gate electrode of the twenty-first transistor is connected to the fifth node. A first electrode of the twenty-first transistor is connected to the second low electric potential input terminal.

In some embodiments, the first drop-down maintaining unit includes the fourth node, a twenty-second transistor, and a twenty-third transistor. A gate electrode of the twenty-second transistor is connected to the third node. A first electrode of the twenty-second transistor is connected to the fourth node. A second electrode of the twenty-second transistor is connected to the first node. A gate electrode of the twenty-third transistor is connected to the third node. A first electrode of the twenty-third transistor is connected to the first low electric potential input terminal. A second electrode of the twenty-third transistor is connected to the fourth node.

Meanwhile, an embodiment of the present disclosure provides a display panel. The display panel includes a gate electrode driving circuit, and the gate electrode driving circuit includes:

a logical addressing unit connected to a first node to pull up electric potentials of the first node and a second node in a plurality of blank time periods;

a pull-up control module connected to the logical addressing unit and the first node and used for pulling up the electric potential of the first node at a plurality of display time periods;

a pull-up unit comprising the first node, a second node, and a low frequency control signal source, wherein the pull-up unit is connected to the pull-up control module and is used for pulling up electric potentials of a first stage transfer signal, a first output signal, and a second output signal;

a first drop-down unit connected to the first node and used for dropping down the electric potential of the first node at an end of the plurality of blank time periods;

a second drop-down unit connected to the first node and used for dropping down the electric potential of the first node at the plurality of display time periods;

a third drop-down unit connected to the second node and used for dropping down the electric potential of the second node at the plurality of display time periods;

a fourth drop-down unit connected to a third node and used for dropping down an electric potential of the third node at a start of the plurality of display time periods;

a first drop-down maintaining unit connected to the first node and used for maintaining a low electric potential of the first node;

a second drop-down maintaining unit used for maintaining low electric potentials of the first stage transfer signal, the first output signal, and the second output signal; and an inverter comprising the third node used for inverting the electric potentials of the first node and the third node.

In some embodiments, the logical addressing unit includes a second stage transfer signal terminal, a first signal input terminal, a high electric potential input terminal, a reset signal terminal, a first transistor, a second transistor, a third transistor, a fourth transistor, a fifth transistor, and a first storage capacitor. A gate electrode of the first transistor is connected to the first signal input terminal. A first electrode of the first transistor is connected to the second stage transfer signal terminal. A second electrode of the first transistor is connected to a first electrode of the second transistor. The second electrode of the first transistor is connected to a second electrode of the third transistor. A gate electrode of the second electrode is connected to the first signal input terminal. A second electrode of the second transistor is connected to a first polar plate of the first storage capacitor. A first electrode of the third transistor is connected to the high electric potential input terminal. A gate electrode of the third transistor is connected to the first polar plate of the first storage capacitor. The high electric potential input terminal is connected to a second polar plate of the first storage capacitor. A gate electrode of the fourth transistor is connected to the first polar plate of the first storage capacitor. A first electrode of the fourth transistor is connected to the high electric potential input terminal. A second electrode of the fourth transistor is connected to a first electrode of the fifth transistor. A gate electrode of the fifth transistor is connected to the reset signal terminal. A second electrode of the fifth transistor is connected to the first node.

In some embodiments, the pull-up control module includes the second stage transfer signal terminal, a fourth node, a sixth transistor, a seventh transistor. A gate electrode and a first electrode of the sixth transistor are connected to the second stage transfer signal terminal. A second electrode of the sixth transistor is connected to the fourth node. A gate electrode of the seventh transistor is connected to the second stage transfer signal terminal. A first electrode of the seventh transistor is connected to the fourth node. A second electrode of the seventh transistor is connected to the first node.

In some embodiments, a first stage transfer signal terminal, a first signal output terminal, and a second signal output terminal are further included, and the pull-up unit includes a first clock signal terminal, a second clock signal terminal, the fourth node, a second storage capacitor, a third storage capacitor, an eighth transistor, a ninth transistor, a tenth transistor, an eleventh transistor, and a twelfth transistor. A gate electrode of the eighth transistor is connected to the first clock signal terminal. A first electrode of the eighth transistor is connected to the first node. A second electrode of the eighth transistor is connected to a gate electrode of the ninth transistor. A first electrode of the ninth transistor is connected to the low frequency control signal source. A second electrode of the ninth transistor is connected to the first stage transfer signal terminal. A gate electrode of the tenth transistor is connected to the second node. A first electrode of the tenth transistor is connected to the first clock signal terminal. A second electrode of the tenth transistor is connected to the first signal output terminal. A gate electrode of the eleventh transistor is connected to the second node. A first electrode of the eleventh transistor is connected to the second clock signal terminal. A second electrode of the eleventh transistor is connected to the second signal output terminal. A gate electrode of the twelfth transistor is connected to the second node. A first electrode of the twelfth transistor is connected to the fourth node. A second electrode of the twelfth transistor is connected to the first signal output terminal. A first polar plate of the second storage capacitor is connected to the second node. A second polar plate of the second storage capacitor is connected to the first signal output terminal. A first polar plate of the third storage capacitor is connected to the second node. A second polar plate of the third storage capacitor is connected to the second signal output terminal.

In some embodiments, the first drop-down unit includes a first low electric potential input terminal, a second signal input terminal, a thirteenth transistor, and a fourteenth transistor. A gate electrode of the thirteenth transistor is connected to the second signal input terminal. A first electrode of the thirteenth transistor is connected to a second electrode of the fourteenth transistor. A second electrode of the thirteenth transistor is connected to the first node. A gate electrode of the fourteenth transistor is connected to the second signal input terminal. A first electrode of the fourteenth transistor is connected to the first low electric potential input terminal.

In some embodiments, the second drop-down unit includes a third stage transfer signal terminal, the fourth node, a fifteenth transistor, and a sixteenth transistor. A gate electrode of the fifteenth transistor is connected to the third stage transfer signal terminal. A first electrode of the fifteenth transistor is connected to the fourth node. A second electrode of the fifth transistor is connected to the first node. A gate electrode of the sixteenth transistor is connected to the third stage transfer signal terminal. A first electrode of the sixteenth transistor is connected to the first low electric potential input terminal. A second electrode of the sixteenth transistor is connected to the fourth node.

In some embodiments, the third drop-down unit includes the third stage transfer signal terminal, the fourth node, a seventeenth transistor, and an eighteenth transistor. A gate electrode of the seventeenth transistor is connected to the third stage transfer signal terminal. A first electrode of the seventeenth transistor is connected to the fourth node. A second electrode of the seventeenth transistor is connected to the second node. A gate electrode of the eighteenth transistor is connected to the third stage transfer signal terminal. A first electrode of the eighteenth transistor is connected to the first low electric potential input terminal. A second electrode of the eighteenth transistor is connected to the fourth node.

In some embodiments, the fourth drop-down unit includes the first stage transfer signal terminal, the reset signal terminal, a fifth node, a nineteenth transistor, a twentieth transistor, and a twenty-first transistor. A gate electrode of the nineteenth transistor is connected to the first stage transfer signal terminal. A first electrode of the nineteenth transistor is connected to a second low electric potential input terminal. A second electrode of the nineteenth transistor is connected to the third node. A gate electrode of the twentieth transistor is connected to the reset signal terminal. A first electrode of the twentieth transistor is connected to a second electrode of the twenty-first transistor. A gate electrode of the twenty-first transistor is connected to the fifth node. A first electrode of the twenty-first transistor is connected to the second low electric potential input terminal.

In some embodiments, the first drop-down maintaining unit includes the fourth node, a twenty-second transistor, and a twenty-third transistor. A gate electrode of the twenty-second transistor is connected to the third node. A first electrode of the twenty-second transistor is connected to the fourth node. A second electrode of the twenty-second transistor is connected to the first node. A gate electrode of the twenty-third transistor is connected to the third node. A first electrode of the twenty-third transistor is connected to the first low electric potential input terminal. A second electrode of the twenty-third transistor is connected to the fourth node.

In some embodiments, the second drop-down maintaining unit includes a third low electric potential input terminal, a twenty-fourth transistor, a twenty-fifth transistor, and a twenty-sixth transistor. A gate electrode of the twenty-fourth transistor is connected to the third node. A first electrode of the twenty-fourth transistor is connected to the first low electric potential input terminal. A second electrode of the twenty-fourth transistor is connected to the first stage transfer signal terminal. A gate electrode of the twenty-fifth transistor is connected to the third node. A first electrode of the twenty-fifth transistor is connected to the third low electric potential input terminal. A second electrode of the twenty-fifth transistor is connected to the first signal output terminal. A gate electrode of the twenty-sixth transistor is connected to the third node. A first electrode of the twenty-sixth transistor is connected to the third low electric potential input terminal. A second electrode of the twenty-sixth transistor is connected to the second signal output terminal.

In some embodiments, the inverter further includes the high electric potential input terminal, the second low electric potential input terminal, a twenty-seventh transistor, a twenty-eighth transistor, a twenty-ninth transistor, and a thirtieth transistor. A gate electrode and a first electrode of the twenty-seventh transistor are connected to the high electric potential input terminal. A second electrode of the twenty-seventh transistor is connected to a first electrode of the twenty-eighth transistor. A gate electrode of the twenty-eighth transistor is connected to the first node. A second electrode of the twenty-eighth transistor is connected to the second low electric potential input terminal. A gate electrode of the twenty-ninth transistor is connected to a second electrode of the twenty-seventh transistor. A first electrode of the twenty-ninth transistor is connected to the high electric potential input terminal. A second electrode of the twenty-ninth transistor is connected to the third node. A gate electrode of the thirtieth transistor is connected to the first node. A first electrode of the thirtieth transistor is connected to the second low electric potential input terminal. A second electrode of the thirtieth transistor is connected to the third node.

Embodiments of the present disclosure provide a gate electrode driving circuit and a display panel. The gate electrode driving circuit includes a logical addressing unit, a pull-up control module, a pull-up unit, a first drop-down unit, a second drop-down unit, a third drop-down unit, a fourth drop-down unit, a first drop-down maintaining unit, a second drop-down maintaining unit, and an inverter. The logical addressing unit is connected to a first node to pull up electric potentials of the first node and a second node in a plurality of blank time periods. The pull-up control module is connected to the logical addressing unit and the first node and is used for pulling up the electric potential of the first node at a plurality of display time periods. The pull-up unit includes the first node, a second node, and a low frequency control signal source. The pull-up unit is connected to the pull-up control module and is used for pulling up electric potentials of a first stage transfer signal, a first output signal, and a second output signal. The first drop-down unit is connected to the first node and is used for dropping down the electric potential of the first node at an end of the plurality of blank time periods. The second drop-down unit is connected to the first node and is used for dropping down the electric potential of the first node at the plurality of display time periods. The third drop-down unit is connected to the second node and is used for dropping down the electric potential of the second node at the plurality of display time periods. The fourth drop-down unit is connected to a third node and used for dropping down an electric potential of the third node at a start of the plurality of display time periods. The first drop-down maintaining unit is connected to the first node and is used for maintaining a low electric potential of the first node. The second drop-down maintaining unit is used for maintaining low electric potentials of the first stage transfer signal, the first output signal, and the second output signal.

The inverter includes the third node used for inverting the electric potentials of the first node and the third node.

By disposing the low frequency control signal source and the third drop-down unit in the gate electrode driving circuit, making the third drop-down unit regulate the electric potential at the second node in the circuits, allowing the corresponding low frequency control signal source to output signals to the first stage transfer signal terminal, and making the low frequency control signal source and the third drop-down unit replace one group of the clock signal, because the low frequency control signal source and the third drop-down unit occupy less space, a width of the gate electrode driving circuit is reduced, thereby reducing a bezel of the display panel, and easing the technical problem of a large number of the clock signal lines causing the larger bezels of the display panels.

DETAILED DESCRIPTION OF PREFERRED EMBODIMENTS

The present disclosure provides a gate electrode driving circuit and a display panel. For making the purposes, technical solutions and effects of the present disclosure be clearer and more definite, the present disclosure will be further described in detail below. It should be understood that the specific embodiments described herein are merely for explaining the present disclosure and are not intended to limit the present disclosure.

Embodiments of the present disclosure aim at addressing the technical problem that a large number of the clock signal lines causes the larger bezels of the display panels exists in the current gate driver on array (GOA) circuits. The embodiments of the present disclosure are used for solving the technical problem.

Figure 1:
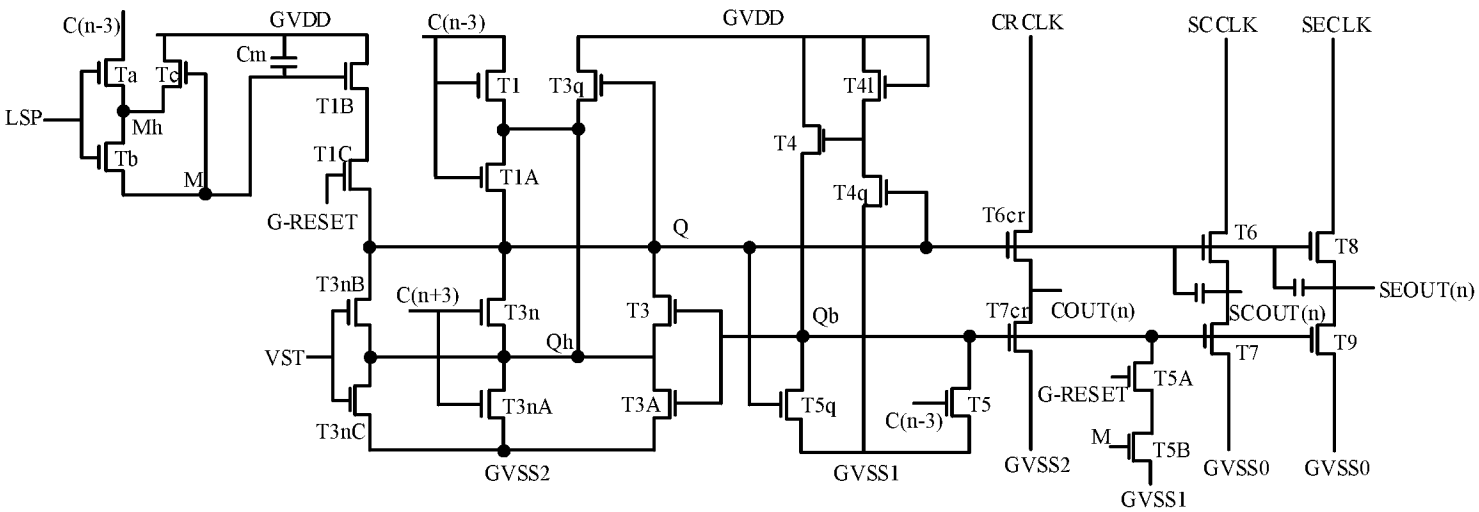
FIG. 1 is a structural schematic diagram of a gate electrode driving circuit in the prior art.
Figure 2:
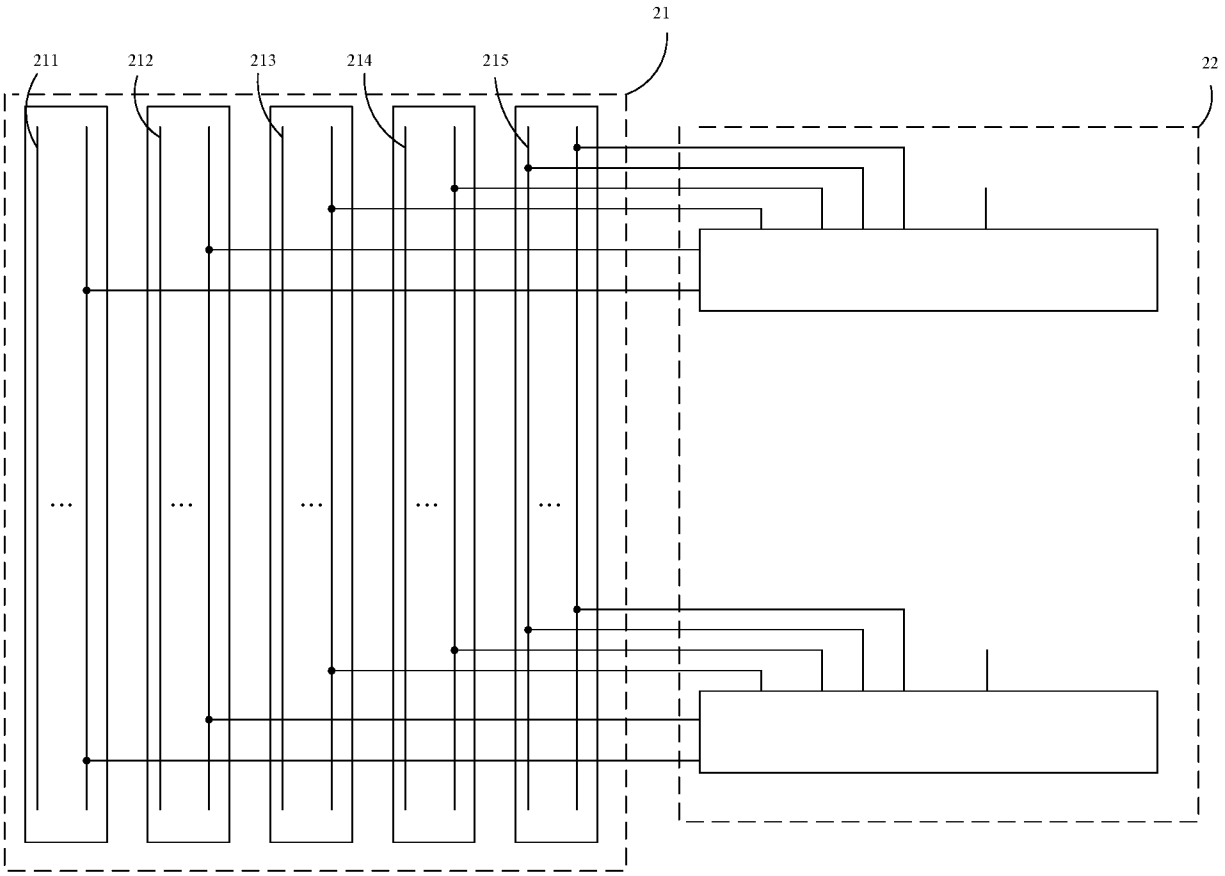
FIG. 2 is a wiring schematic diagram of the gate electrode driving circuit in the prior art.

As illustrated in FIG. 1, a current GOA circuit, that is, a gate electrode driving circuit, includes a transistor Ta, a transistor Tb, a transistor Tc, a transistor T1B, a transistor T1C, a transistor T1, a transistor T1A, a transistor T3*q*, a transistor T3, a transistor T3A, a transistor T3*n*, a transistor T3*n*A, a transistor T3*n*B, a transistor T3*nc*, a transistor T4, a transistor T41, a transistor T4*q*, a transistor T5*q*, a transistor T5, a transistor TSA, a transistor TSB, a transistor T6*cr*, a transistor T6, a transistor T7, a transistor T7*cr*, a transistor T8, a transistor T9, a storage capacitor Cm, a connection node Mh, a connection node M, a connection node Q, a connection node Qh, a connection node Qb, a stage transfer signal C(n−3), a stage transfer signal C(n+3), a stage transfer signal Cout(n), an input signal LSP, an input signal VST, a reset signal G-RESET, a high electric potential power source signal GVDD, a low electric potential power source signal GVSS0, a low electric potential power source signal GVSS1, a low electric potential power source signal GVSS2, a sequence signal CRCLK, a sequence signal SCCLK, a sequence signal SECLK, an output signal SCOUT(n), and an output signal SEOUT(n). A connection method of the gate electrode driving circuit is illustrated as FIG. 1. From FIG. 1, it can be understood that the sequence signal CRCLK is used for providing a stage transfer signal, and the sequence signal SCCLK and the sequence signal SECLK are used for providing stable driving signals to pixels. As illustrated in FIG. 2, wiring of the gate electrode driving circuit includes a circuit region 22 and a metal wiring region 21. The circuit region 22 includes a plurality of transistors, storage capacitors, and metal wirings between the transistors and between the transistors and the storage capacitors. The metal wiring region 21 includes a pulse signal line 211, a Cka clock signal line 212, a Ckb clock signal line 213, a Ckc clock signal line 214, and a direct current signal line 215. Furthermore, Cka provided the CRCLK signal in the FIG. 1, and Ckb and Ckc respectively provide the SCCLK signal and the SECLK signal in the FIG. 1. In order to lower impedance of the clock signal lines, each group of the clock signal lines includes twelve clock signal lines. For example, the Cka clock signal line includes a CKa1 clock signal line to a CKa12 clock signal line, and the large number of Cka clock signal lines leads to a larger bezel of the display panel, that is, the technical problem that the large number of the clock signal lines causes the larger bezels of the display panels to exist in the current GOA circuits.

Figure 3:
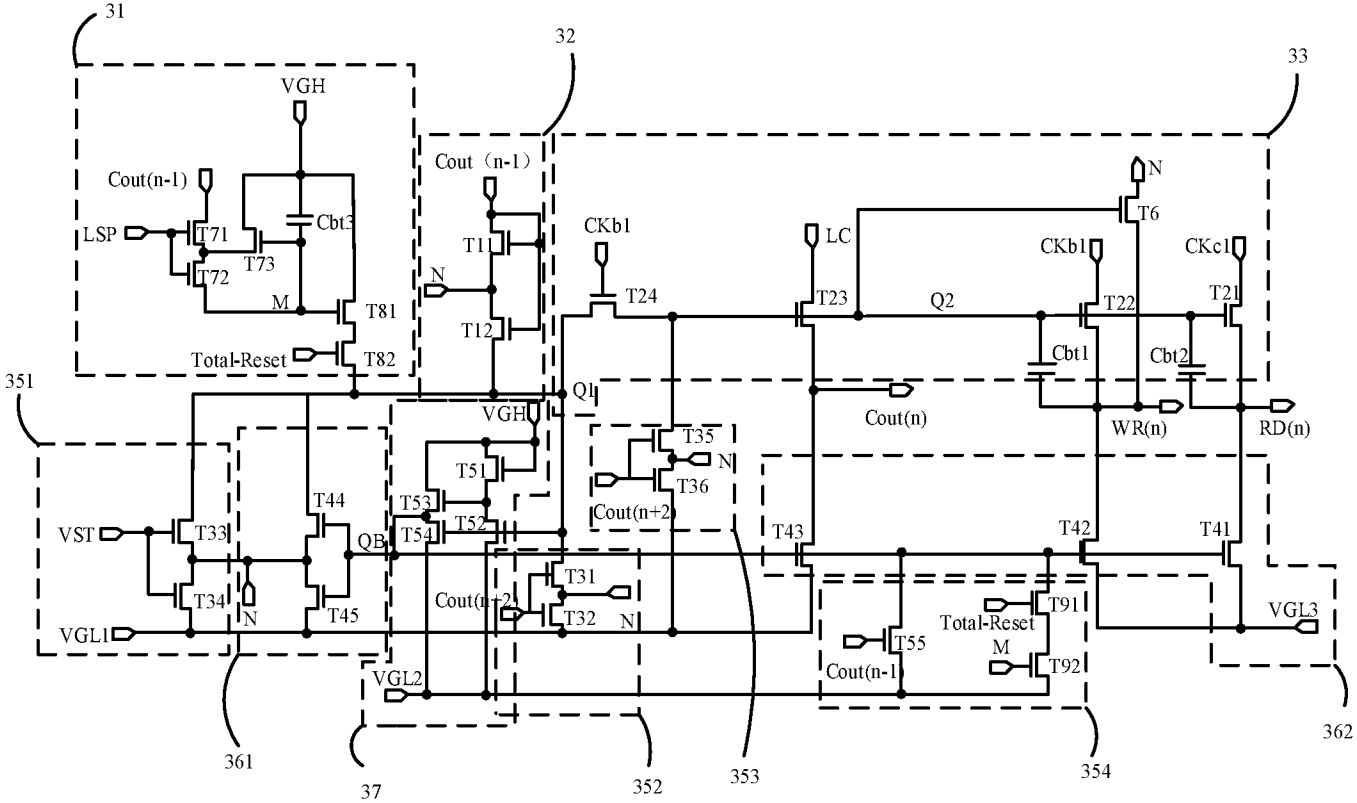
FIG. 3 is a structural schematic diagram of a gate electrode driving circuit provided by an embodiment of the present disclosure.
Figure 5:
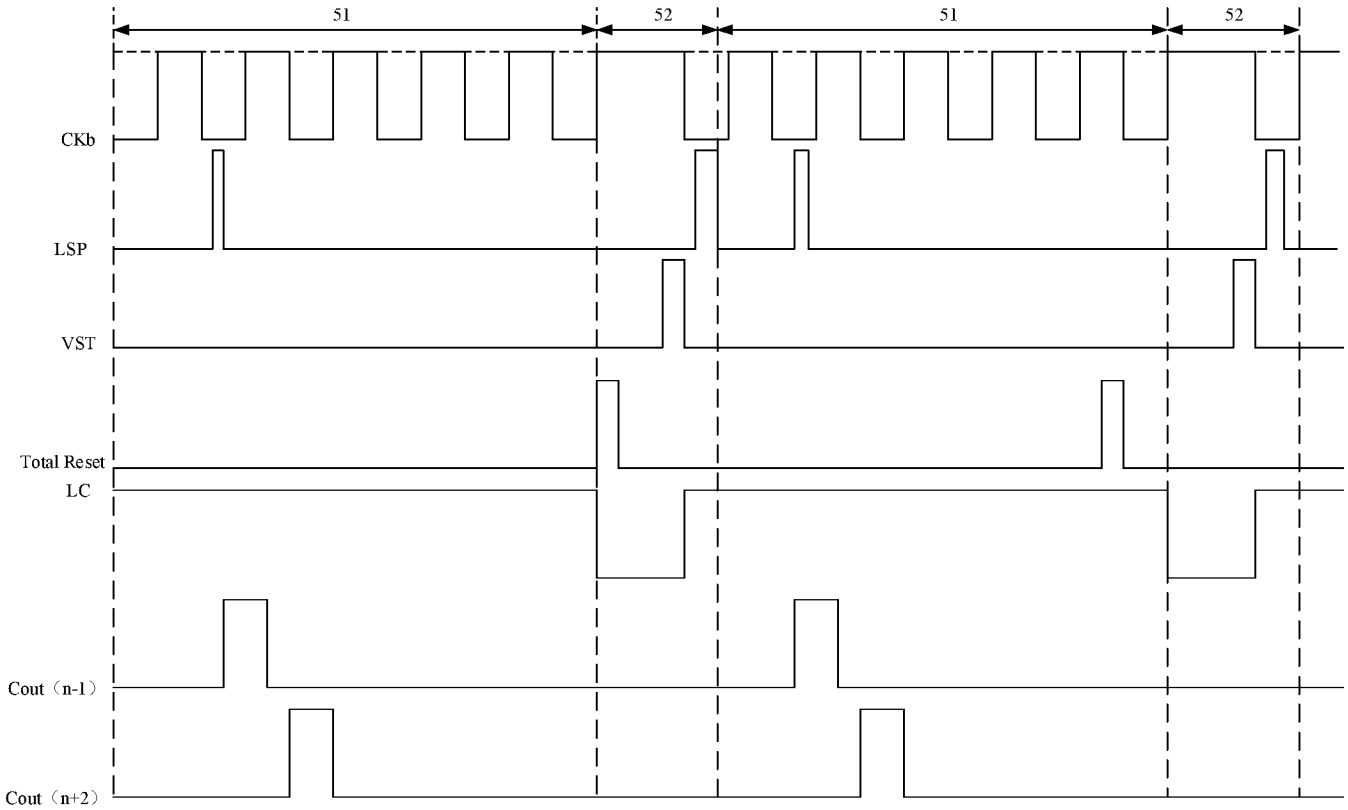
FIG. 5 is a sequence diagram of the gate electrode driving circuit provided by an embodiment of the present disclosure.

As illustrated in FIG. 3 and FIG. 5, an embodiment of the present disclosure provides a gate electrode driving circuit. The gate electrode driving circuit includes:

a logical addressing unit 31 connected to a first node Q1 to pull up electric potentials of the first node Q1 and a second node Q2 in a plurality of blank time periods 52;

a pull-up control module 32 connected to the logical addressing unit 31 and the first node Q1 and used for pulling up the electric potential of the first node Q1 at a plurality of display time periods 51;

a pull-up unit 33 including the first node Q1, the second node Q2, and a low frequency control signal source LC, wherein the pull-up unit 33 is connected to the pull-up control module 32 and is used for pulling up electric potentials of a first stage transfer signal, a first output signal, and a second output signal;

a first drop-down unit 351 connected to the first node Q1 and used for dropping down the electric potential of the first node Q1 at an end of the plurality of blank time periods 52;

a second drop-down 352 unit connected to the first node Q1 and used for dropping down the electric potential of the first node Q1 at the plurality of display time periods 51;

a third drop-down unit 353 connected to the second node Q2 and used for dropping down the electric potential of the second node Q2 at the plurality of display time periods 51;

a fourth drop-down unit 354 connected to a third node QB and used for dropping down an electric potential of the third node QB at a start of the plurality of display time periods 51;

a first drop-down maintaining unit 361 connected to the first node Q1 and used for maintaining a low electric potential of the first node Q1;

a second drop-down maintaining unit 362 used for maintaining low electric potentials of the first stage transfer signal, the first output signal, and the second output signal; and an inverter 37 including the third node QB used for inverting the electric potentials of the first node Q1 and the third node QB.

An embodiment of the present disclosure provides a gate electrode driving circuit. The gate electrode driving circuit includes a logical addressing unit, a pull-up control module, a pull-up unit, a first drop-down unit, a second drop-down unit, a third drop-down unit, a fourth drop-down unit, a first drop-down maintaining unit, a second drop-down maintaining unit, and an inverter. The logical addressing unit is connected to a first node to pull up electric potentials of the first node and a second node in a plurality of blank time periods. The pull-up control module is connected to the logical addressing unit and the first node and is used for pulling up the electric potential of the first node at a plurality of display time periods. The pull-up unit includes the first node, a second node, and a low frequency control signal source. The pull-up unit is connected to the pull-up control module and is used for pulling up electric potentials of a first stage transfer signal, a first output signal, and a second output signal. The first drop-down unit is connected to the first node and is used for dropping down the electric potential of the first node at an end of the plurality of blank time periods. The second drop-down unit is connected to the first node and is used for dropping down the electric potential of the first node at the plurality of display time periods. The third drop-down unit is connected to the second node and is used for dropping down the electric potential of the second node at the plurality of display time periods. The fourth drop-down unit is connected to a third node and used for dropping down an electric potential of the third node at a start of the plurality of display time periods. The first drop-down maintaining unit is connected to the first node and is used for maintaining a low electric potential of the first node. The second drop-down maintaining unit is used for maintaining low electric potentials of the first stage transfer signal, the first output signal, and the second output signal. The inverter includes the third node used for inverting the electric potentials of the first node and the third node.

By disposing the low frequency control signal source and the third drop-down unit in the gate electrode driving circuit, making the third drop-down unit regulate the electric potential at the second node in the circuits, allowing the corresponding low frequency control signal source to output signals to the first stage transfer signal terminal, and making the low frequency control signal source and the third drop-down unit replace one group of the clock signal, because the low frequency control signal source and the third drop-down unit occupy less space, a width of the gate electrode driving circuit can be reduced, thereby reducing a bezel of the display panel, and easing the technical problem of a large number of the clock signal lines causing the larger bezels of the display panels.

It should be noted that a first stage transfer signal terminal Cout(n) outputs the first stage transfer signal, a first signal output terminal WR(n) outputs the first output signal, and a second signal output terminal RD(n) outputs the second output signal.

Figure 4:
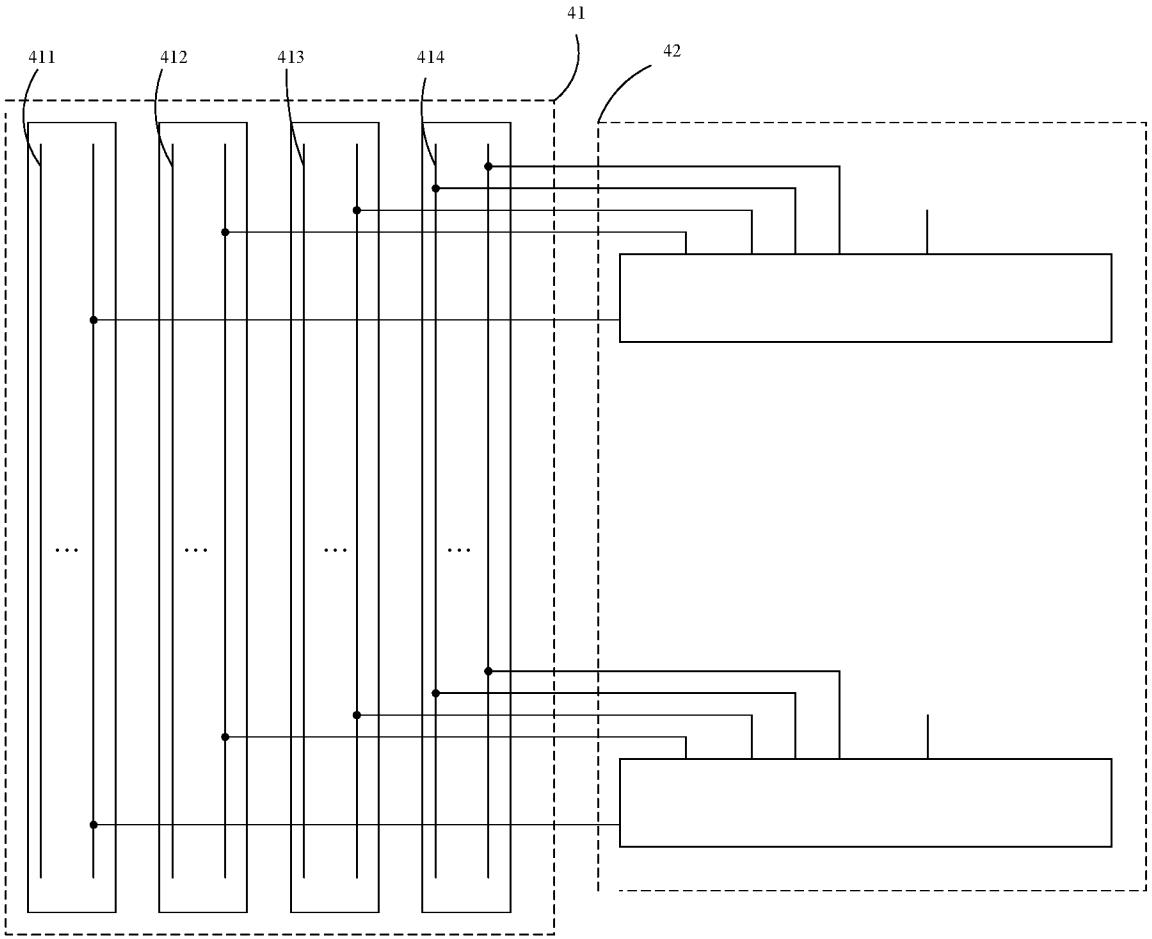
FIG. 4 is a wiring schematic diagram of the gate electrode driving circuit provided by an embodiment of the present disclosure.

As illustrated in FIG. 4, after using the gate electrode driving circuit provided by the embodiments of the present disclosure, wirings of the gate electrode driving circuit include a circuit region 42 and a metal wiring region 41. A plurality of transistors, a plurality of storage capacitors, signal input terminals, signal output terminals, a metal wiring between the transistors, a metal wiring between the transistors and the storage capacitors, a metal wiring between the transistors and the signal input terminals, a metal wiring between the transistors and the signal output terminals, and metal wirings between each of other elements are disposed in the circuit region 42. A pulse signal line 411, a first clock signal line 412, a second clock signal line 431, and a direct current signal line 414 are disposed on the metal wiring region 41. The first clock signal line 412 includes twelve clock signal lines corresponding to Ckb1 in FIG. 3. The second clock signal line 413 includes twelve clock signal lines corresponding to Ckc1 in FIG. 3. From FIG. 4, it can be understood that by the gate electrode driving circuit provided by the embodiments of the present disclosure, only two groups of clock signal lines are needed on the metal wiring region, and one group of the clock signal lines is omitted, thereby reducing the bezel of the display panel.

In an embodiment, as illustrated in FIG. 3, the logical addressing unit 31 includes a second stage transfer signal terminal Cout(n−1), a first signal input terminal LSP, a high electric potential input terminal VGH, a reset signal terminal Total-Reset, a first transistor T71, a second transistor T72, a third transistor T73, a fourth transistor T81, a fifth transistor T82, and a first storage capacitor Cbt3. A gate electrode of the first transistor T71 is connected to the first signal input terminal LSP. A first electrode of the first transistor T71 is connected to the second stage transfer signal terminal Cout (n−1). A second electrode of the first transistor T71 is connected to a first electrode of the second transistor T72. The second electrode of the first transistor T71 is connected to a second electrode of the third transistor T73. A gate electrode of the second electrode T72 is connected to the first signal input terminal LSP. A second electrode of the second transistor T72 is connected to a first polar plate of the first storage capacitor Cbt3. A first electrode of the third transistor T73 is connected to the high electric potential input terminal VGH. A gate electrode of the third transistor T73 is connected to the first polar plate of the first storage capacitor Cbt3. The high electric potential input terminal VGH is connected to a second polar plate of the first storage capacitor Cbt3. A gate electrode of the fourth transistor T81 is connected to the first polar plate of the first storage capacitor Cbt3. A first electrode of the fourth transistor T81 is connected to the high electric potential input terminal VGH. A second electrode of the fourth transistor T81 is connected to a first electrode of the fifth transistor T82. A gate electrode of the fifth transistor T82 is connected to the reset signal terminal Total-Reset. A second electrode of the fifth transistor T82 is connected to the first node Q1.

In an embodiment, as illustrated in FIG. 3, the pull-up control module 32 includes the second stage transfer signal terminal Cout(n−1), a fourth node N, a sixth transistor T11, and a seventh transistor T12. A gate electrode and a first electrode of the sixth transistor T11 are connected to the second stage transfer signal terminal Cout(n−1). A second electrode of the sixth transistor T11 is connected to the fourth node N. A gate electrode of the seventh transistor T12 is connected to the second stage transfer signal terminal Cout(n−1). A first electrode of the seventh transistor T12 is connected to the fourth node N. A second electrode of the seventh transistor T12 is connected to the first node Q1.

In an embodiment, as illustrated in FIG. 3, the gate electrode driving circuit further includes a first stage transfer signal terminal Cout(n), a first signal output terminal WR(n), and a second signal output terminal RD(n). The pull-up unit 33 further includes a first clock signal terminal CKb1, a second clock signal terminal CKc1, the fourth node N, a second storage capacitor Cbt1, a third storage capacitor Cbt2, an eighth transistor T24, a ninth transistor T23, a tenth transistor T22, an eleventh transistor T21, and a twelfth transistor T6. A gate electrode of the eighth transistor T24 is connected to the first clock signal terminal CKb1. A first electrode of the eighth transistor T24 is connected to the first node Q1. A second electrode of the eighth transistor T24 is connected to a gate electrode of the ninth transistor T23. A first electrode of the ninth transistor T23 is connected to the low frequency control signal source LC. A second electrode of the ninth transistor T23 is connected to the first stage transfer signal terminal Cout(n). A gate electrode of the tenth transistor T22 is connected to the second node Q2. A first electrode of the tenth transistor T22 is connected to the first clock signal terminal CKb1. A second electrode of the tenth transistor T22 is connected to the first signal output terminal WR(n). A gate electrode of the eleventh transistor T21 is connected to the second node Q2. A first electrode of the eleventh transistor T21 is connected to the second clock signal terminal CKc1. A second electrode of the eleventh transistor T21 is connected to the second signal output terminal RD(n). A gate electrode of the twelfth transistor T6 is connected to the second node Q6. A first electrode of the twelfth transistor T6 is connected to the fourth node N. A second electrode of the twelfth transistor T6 is connected to the first signal output terminal WR(n). A first polar plate of the second storage capacitor Cbt1 is connected to the second node Q2. A second polar plate of the second storage capacitor Cbt1 is connected to the first signal output terminal WR(n). A first polar plate of the third storage capacitor Cbt2 is connected to the second node Q2. A second polar plate of the third storage capacitor Cbt2 is connected to the second signal output terminal RD(n).

In an embodiment, as illustrated in FIG. 3, the first drop-down unit 351 includes a first low electric potential input terminal VGL1, a second signal input terminal VST, a thirteenth transistor T33, and a fourteenth transistor T34. A gate electrode of the thirteenth transistor T33 is connected to the second signal input terminal VST. A first electrode of the thirteenth transistor T33 is connected to a second electrode of the fourteenth transistor T34. A second electrode of the thirteenth transistor T33 is connected to the first node Q1. A gate electrode of the fourteenth transistor T34 is connected to the second signal input terminal VST. A first electrode of the fourteenth transistor T34 is connected to the first low electric potential input terminal VGL1.

In an embodiment, as illustrated in FIG. 3, the second drop-down unit 352 includes a third stage transfer signal terminal Cout(n+2), the fourth node N, a fifteenth transistor T31, and a sixteenth transistor T32. A gate electrode of the fifteenth transistor T31 is connected to the third stage transfer signal terminal Cout(n+2). A first electrode of the fifteenth transistor T31 is connected to the fourth node N. A second electrode of the fifth transistor T31 is connected to the first node Q1. A gate electrode of the sixteenth transistor T32 is connected to the third stage transfer signal terminal Cout(n+2). A first electrode of the sixteenth transistor T32 is connected to the first low electric potential input terminal VGL1. A second electrode of the sixteenth transistor T32 is connected to the fourth node N.

In an embodiment, as illustrated in FIG. 3, the third drop-down unit 353 includes the third stage transfer signal terminal Cout(n+2), the fourth node N, a seventeenth transistor T35, and an eighteenth transistor T36. A gate electrode of the seventeenth transistor T35 is connected to the third stage transfer signal terminal Cout(n+2). A first electrode of the seventeenth transistor T35 is connected to the fourth node N. A second electrode of the seventeenth transistor T35 is connected to the second node Q2. A gate electrode of the eighteenth transistor T36 is connected to the third stage transfer signal terminal Cout(n+2). A first electrode of the eighteenth transistor T36 is connected to the first low electric potential input terminal VGL1. A second electrode of the eighteenth transistor T36 is connected to the fourth node N.

In an embodiment, as illustrated in FIG. 3, the fourth drop-down unit 354 includes the first stage transfer signal terminal Cout(n−1), the reset signal terminal Total-Reset, a fifth node M, a nineteenth transistor T55, a twentieth transistor T91, and a twenty-first transistor T92. A gate electrode of the nineteenth transistor T55 is connected to the first stage transfer signal terminal Cout(n−1). A first electrode of the nineteenth transistor T55 is connected to a second low electric potential input terminal VGL2. A second electrode of the nineteenth transistor T55 is connected to the third node QB. A gate electrode of the twentieth transistor T91 is connected to the reset signal terminal Total-Reset. A first electrode of the twentieth transistor T91 is connected to a second electrode of the twenty-first transistor T92. A gate electrode of the twenty-first transistor T92 is connected to the fifth node M. A first electrode of the twenty-first transistor T92 is connected to the second low electric potential input terminal VGL2.

In an embodiment, as illustrated in FIG. 3, the first drop-down maintaining unit 361 includes the fourth node N, a twenty-second transistor T44, and a twenty-third transistor T45. A gate electrode of the twenty-second transistor T44 is connected to the third node QB. A first electrode of the twenty-second transistor T44 is connected to the fourth node N. A second electrode of the twenty-second transistor T44 is connected to the first node Q1. A gate electrode of the twenty-third transistor T45 is connected to the third node QB. A first electrode of the twenty-third transistor T45 is connected to the first low electric potential input terminal VGL1. A second electrode of the twenty-third transistor T45 is connected to the fourth node N.

In an embodiment, as illustrated in FIG. 3, the second drop-down maintaining unit 362 includes a third low electric potential input terminal VGL3, a twenty-fourth transistor T43, a twenty-fifth transistor T42, and a twenty-sixth transistor T41. A gate electrode of the twenty-fourth transistor T43 is connected to the third node QB. A first electrode of the twenty-fourth transistor T43 is connected to the first low electric potential input terminal VGL1. A second electrode of the twenty-fourth transistor T43 is connected to the first stage transfer signal terminal Cout(n). A gate electrode of the twenty-fifth transistor T42 is connected to the third node QB. A first electrode of the twenty-fifth transistor T42 is connected to the third low electric potential input terminal VGL3. A second electrode of the twenty-fifth transistor T42 is connected to the first signal output terminal WR(n). A gate electrode of the twenty-sixth transistor T41 is connected to the third node QB. A first electrode of the twenty-sixth transistor T41 is connected to the third low electric potential input terminal VGL3. A second electrode of the twenty-sixth transistor T41 is connected to the second signal output terminal RD(n).

In an embodiment, as illustrated in FIG. 3, the inverter 37 further includes the high electric potential input terminal VGH, the second low electric potential input terminal VGL2, a twenty-seventh transistor T51, a twenty-eighth transistor T52, a twenty-ninth transistor T53, and a thirtieth transistor T54. A gate electrode and a first electrode of the twenty-seventh transistor T51 are connected to the high electric potential input terminal VGH. A second electrode of the twenty-seventh transistor T51 is connected to a first electrode of the twenty-eighth transistor T52. A gate electrode of the twenty-eighth transistor T52 is connected to the first node Q1. A second electrode of the twenty-eighth transistor T52 is connected to the second low electric potential input terminal VGL2. A gate electrode of the twenty-ninth transistor T53 is connected to a second electrode of the twenty-seventh transistor T51. A first electrode of the twenty-ninth transistor T53 is connected to the high electric potential input terminal VGH. A second electrode of the twenty-ninth transistor T53 is connected to the third node QB. A gate electrode of the thirtieth transistor T54 is connected to the first node Q1. A first electrode of the thirtieth transistor T54 is connected to the second low electric potential input terminal VGL2. A second electrode of the thirtieth transistor T54 is connected to the third node QB.

It should be noted that the plurality of fourth nodes N in FIG. 3 indicate that each of the fourth nodes N are connected to each other, and the plurality of fifth nodes M in FIG. 3 indicate that each of the fifth nodes M are connected to each other.

It should be noted that a working time in a frame of the gate electrode driving circuit provided by the embodiments of the present disclosure as illustrated in FIG. 5 includes the plurality of display time periods 51 and the plurality of blank time periods 52, wherein the plurality of display time periods 51 are an actual display time of the display panel, and the plurality of blank time periods are time periods between each of the plurality of display time periods.

It should be noted that the gate electrode driving circuit in the display panel includes a plurality of multi-stage gate electrode driving units, wherein illustrated in FIG. 3 is an nth-stage gate electrode driving unit, a stage transfer signal outputted by the first stage transfer signal terminal Cout(n) is a current-stage stage transfer signal, a stage transfer signal inputted by the second stage transfer signal terminal Cout (n−1) is a stage transfer signal outputted by a previous-stage gate electrode driving unit, and a stage transfer signal inputted by the third stage transfer signal terminal Cout(n+2) is a stage transfer signal outputted by a next-two-stage gate electrode driving unit.

Illustrated in FIG. 5 is a sequence diagram of the gate electrode driving circuit provided by an embodiment of the present disclosure. In FIG. 5, each signal terminal or node corresponding to curves of the highest voltage and lowest voltage are illustrated as the following table:

TABLE 1

| | configuration voltage | |
|---|---|---|
| GOA signal | low electric potential | high electric potential |
| Cout (n − 1) | −13 | +20 |
| Cout (n + 2) | −13 | +20 |
| LSP | −13 | +20 |
| LSP | −13 | +20 |
| Total-Reset | −13 | +20 |
| LC | −13 | +20 |
| CKb | −13 | +20 |
| CKc | −13 | +20 |
| VGH | +20 | |
| VGL1 | −13 | |
| VGL2 | −10 | |
| VGL3 | −6 | |

As illustrated in FIG. 3 to FIG. 7, the following embodiments are described specifically by combining the gate electrode driving circuit and the sequence diagram of the gate electrode driving circuit versus a working process of the gate electrode driving circuit.

Figure 6:
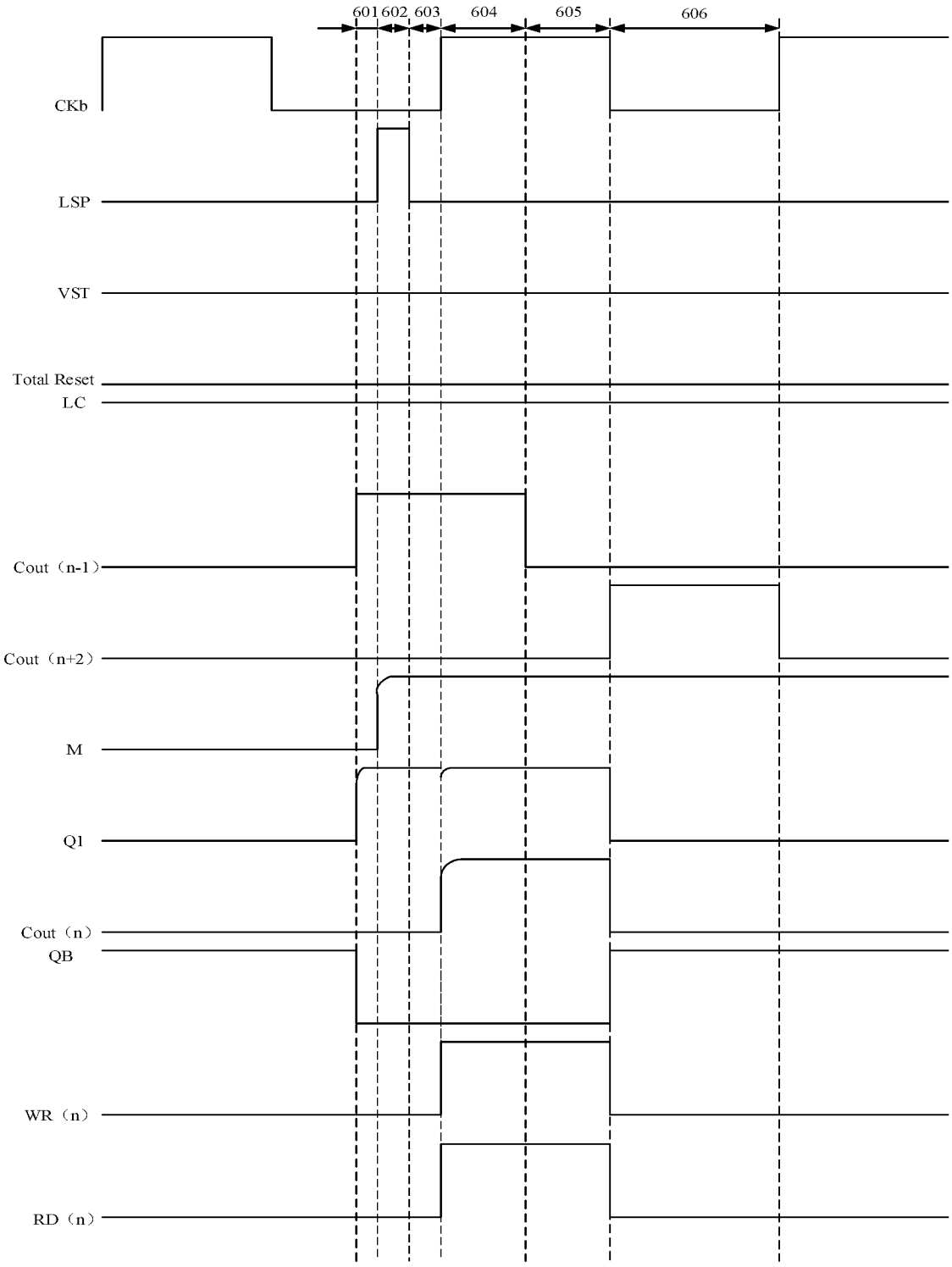
FIG. 6 is a sequence diagram of a plurality of display time periods of the gate electrode driving circuit provided by an embodiment of the present disclosure.
Figure 7:
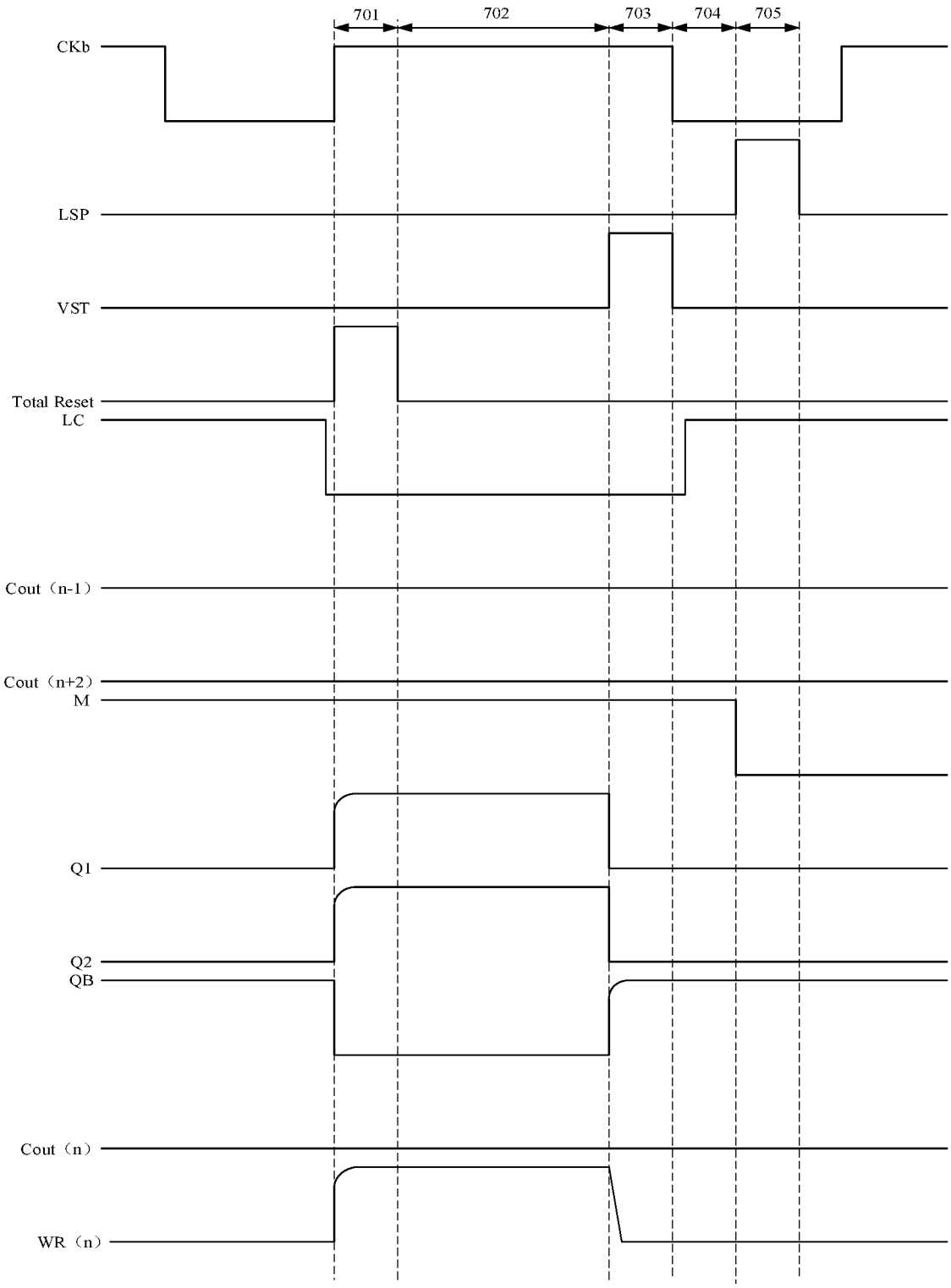
FIG. 7 is a sequence diagram of a plurality of blank time periods of the gate electrode driving circuit provided by an embodiment of the present disclosure.

It should be noted that CKb in the table 1 corresponds to CKb1 in FIG. 3, sequence diagrams of CKb in FIG. 5 to FIG. 7 correspond to CKb1 in the FIG. 3, CKc in the table 1 corresponds to CKc1 in the FIG. 3, and meanwhile the sequence diagram of using CKb and the sequence diagram of using CKc are similar or even same. A sequence diagram of CKc is not illustrated in FIG. 5 to FIG. 7, and the sequence diagram of CKc is based on the sequence diagram of CKb.

As illustrated in FIG. 3 and FIG. 6, FIG. 6 is a sequence diagram of a plurality of display time periods of the gate electrode driving circuit provided by an embodiment of the present disclosure. The plurality of display time periods include a first display time period 601, a second display time period 602, a third display time period 603, a fourth display time period 604, a fifth display time period 605, and a sixth display time period 606.

In the first display time period 601, the second stage transfer signal terminal Cout(n−1) is changed from low electric potential to high electric potential, resulting in the sixth transistor T11 and the seventh transistor T12 turning on, high electric potential of the second stage transfer signal terminal Cout(n−1) transferring to the first node Q1, and making the electric potential of the first node Q1 pull up to high electric potential. Meanwhile, electric potential of the first clock signal terminal CKb1 at this time is low electric potential, thereby making the eighth transistor T24 turn off, and the second node Q2 maintain low electric potential. Moreover, because the inverter is connected between the first node Q1 and the third node QB, the electric potentials of the first node Q1 and the third node QB are opposite. Therefore, the electric potential of the third node QB is low electric potential. Furthermore, because the electric potential of the third node QB is low electric potential, the twenty-second transistor T44, the twenty-third transistor T45, the twenty-fourth transistor T43, the twenty-fifth transistor T42, and the twenty-sixth transistor T41 are turned off. Meanwhile, because low electric potential is inputted in the third stage transfer signal terminal Cout(n+2), making the fifteenth transistor T31 and the sixteenth transistor T32 turn off, the corresponding first stage transfer signal terminal Cout(n) maintain low electric potential, and the first signal output terminal WR(n) output low electric potential and the second signal output terminal RD(n) output low electric potential.

In the second display time period 602, the first signal input terminal LSP changes from low electric potential to high electric potential, At this time, the second stage transfer signal terminal Cout(n−1) continuously inputs high electric potential, making the electric potential of the fifth node M be pulled up to high electric potential after through the first transistor T71 and the second transistor T72. Correspondingly, the fourth transistor T81 is turned on. At this time, because the reset signal terminal Total-Reset and the second signal input terminal VST are inputted low electric potential, the fifth transistor T82 is turned off, thereby making the first node Q1 maintain high electric potential and the second node Q2 and the third node QB maintain low electric potential.

In the third display time period 603, the first signal input terminal LSP is changed from high electric potential to low electric potential, making the first transistor T71 and the second transistor T72 turn off, the first node Q1 maintain high electric potential, and the second node Q2 and the third node QB maintain low electric potential.

In the fourth display time period 604, the first clock signal terminal CKb and the second clock signal terminal CKc are changed from low electric potential to high electric potential, making the eighth transistor T24 turn on and the electric potential of the second node Q2 pull up, resulting in the first stage transfer signal terminal Cout(n), the first signal outputting terminal WR(n), and the second signal output terminal RD(n) outputting high electric potential.

In the fifth display time period 605, the second stage transfer signal terminal Cout(n−1) is lowered from high electric potential to low electric potential, making the sixth transistor T11 and the seventh transistor T12 turn off, thereby making the first node Q1 maintain high electric potential, while making the third node QB maintain low electric potential, and the first stage transfer signal terminal Cout(n), the first signal output terminal WR(n), and the second signal output terminal RD(n) maintain high electric potential.

In the sixth display time period 606, the third stage transfer signal terminal Cout(n+2) is pulled up from low electric potential to high electric potential, making the fifteenth transistor T31, the sixteenth transistor T32, the seventeenth transistor T35, and the eighteenth transistor T36 turn on, and correspondingly, the first low electric potential input terminal VGL1 drops down the electric potentials of the first node Q1 and the second node Q2. Because the electric potentials of the first node Q1 and the second node QB are opposite, it can be understood that electric potential of the third node QB is pulled up to high electric potential. Furthermore, because the electric potential of the third node QB is high electric potential, making the twenty-second transistor T44, the twenty-third transistor T45, the twenty-fourth transistor T43, the twenty-fifth transistor T42, and the twenty-sixth transistor T41 turn on, thereby making the first stage transfer signal terminal Cout(n), the first signal output terminal WR(n), and the second signal output terminal RD(n) be dropped down to low electric potential.

As illustrated in FIG. 3 and FIG. 7, FIG. 7 is a sequence diagram of a plurality of blank time periods of the gate electrode driving circuit provided by an embodiment of the present disclosure. The plurality of blank time periods includes a first blank time period 701, a second blank time period 702, a third blank time period 703, a fourth blank time period 704, and a fifth blank time period 705.

In the first blank time period 701, because the reset signal terminal Total-Reset is changed from low electric potential to high electric potential, making the fifth transistor T82 turn on, the electric potential of the first node Q1 pull up to high electric potential, and the corresponding ninth transistor T23, the tenth transistor T22, the eleventh transistor T21, the twenty-eighth transistor T52, and the thirtieth transistor T54 turn on. Because electric potentials of the first node Q1 and the third node QB are opposite, making the electric potential of the third node drop down from high electric potential to low electric potential, and the corresponding twenty-second transistor T44, twenty-third transistor T45, twenty-fourth transistor T43, twenty-fifth transistor T42, and twenty-sixth transistor T41 turn off. Meanwhile, the third stage transfer signal terminal Cout(n+2) is at low electric potential, making the fifteenth transistor T31 and the sixteenth transistor T32 turn off. Meanwhile, the second signal input terminal VST is at low electric potential, making the thirteenth transistor T33 and the fourteenth transistor T34 turn off. Meanwhile, the first clock signal terminal CKb and the second clock signal terminal CKc are changed from low electric potential to high electric potential, making the eighth transistor T24 turn on, the second node Q2 pull up to high electric potential, and the corresponding first signal output terminal WR(n) and second signal output terminal RD(n) output high electric potential. Furthermore, because the low frequency control signal terminal LC is changed from high electric potential to low electric potential, making the first stage transfer signal terminal Cout(n) output low electric potential.

In the second blank time period 702, because the reset signal terminal Total-Reset is changed from high electric potential to low electric potential, making the fifth transistor T82 turn off. At this time, the first clock signal terminal CKb and the second signal output terminal CKc maintain high electric potentials, and the low frequency control signal terminal LC maintain low electric potential, making the first stage transfer signal terminal Cout(n) maintain low electric potential, and the first signal output terminal WR(n) and the second signal output terminal RD(n) output high electric potential.

In the third blank time period 703, the second signal input terminal VST is changed from low electric potential to high electric potential, making the thirteenth transistor T33 and the fourteenth transistor T34 turn on, and the electric potential of the first node Q1 drop down to low electric potential. Furthermore, because the first clock signal terminal CKb maintains high electric potential, making the eighth transistor T24 turn on, the second node Q2 drop down to low electric potential, the corresponding ninth transistor T23, tenth transistor T22, eleventh transistor T21, twenty-eighth transistor T52, and thirtieth transistor T54 turn off, the electric potential of the third node QB pull up to high electric potential, the corresponding twenty-second transistor T44, twenty-third transistor T45, twenty-fourth transistor T43, twenty-fifth transistor T42, and twenty-sixth transistor T41 turn on, the first stage transfer signal terminal Cout(n) maintain low electric potential, and the first signal output terminal WR(n) and the second signal output terminal RD(n) drop down to low electric potential.

In the fourth blank time period 704, the second signal input terminal VST is changed from high electric potential to low electric potential, making the thirteenth transistor T33 and the fourteenth transistor T34 turn off, the first stage transfer signal terminal Cout(n), the first signal output terminal WR(n), and the second signal output terminal RD(n) maintain low electric potential.

In the fifth blank time period 705, the first signal input terminal LSP is changed from low electric potential to high electric potential, making the first transistor T71 and the second transistor T72 turn on. Because the second stage transfer signal terminal Cout(n−1) maintain low electric potential, the fifth node M is reset to be low electric potential, the fourth transistor T81 is turned off, and the fifth node Q1, the second node Q2, the first stage transfer signal terminal Cout(n), the first signal output terminal WR(n), and the second signal output terminal RD(n) maintain low electric potential.

Figure 8:
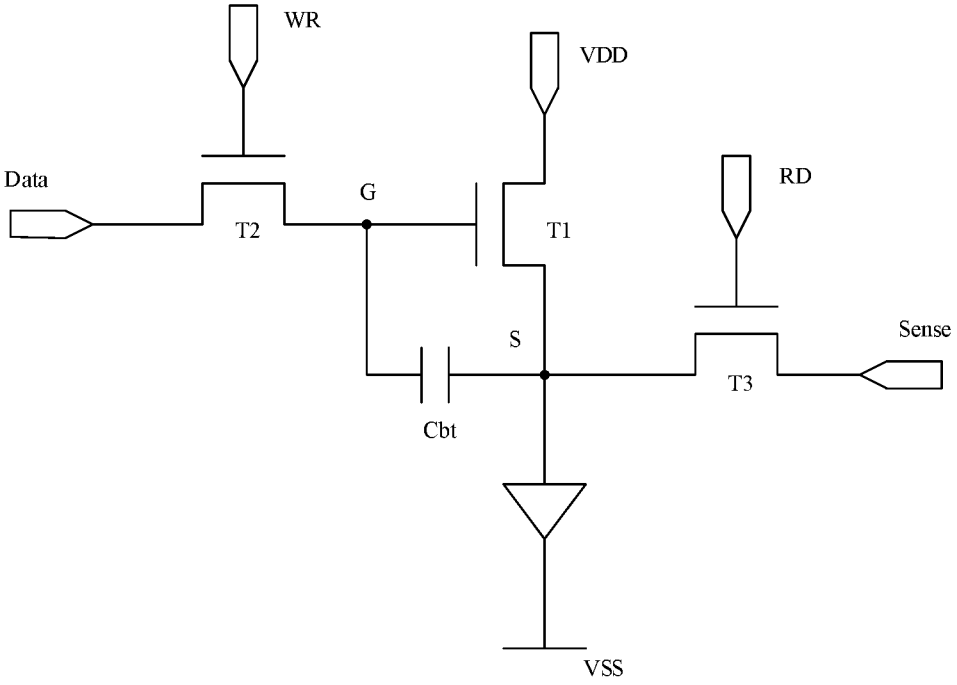
FIG. 8 is a structural schematic diagram of a pixel circuit provided by an embodiment of the present disclosure.

As illustrated in FIG. 8, an embodiment of the present disclosure provides a pixel circuit. The pixel circuit includes a data signal terminal Data, a thirty-first transistor T1, a thirty-second transistor T2, a thirty-third transistor T3, a storage capacitor Cbt, a first signal output terminal WR, a second signal output terminal RD, a first power source voltage terminal VDD, a second power source voltage terminal VSS, a gate electrode node G, a source electrode node S, and a sensing signal input terminal Sense. The first signal output terminal WR corresponds to the first signal output terminal WR(n) in the gate electrode driving circuit. The second signal output terminal RD corresponds to the second signal output terminal RD(n) in the gate electrode driving circuit. By using the gate electrode driving circuit provided by the embodiment of the present disclosure to provide driving signals of the pixel circuit, the width of the gate electrode driving circuit is reduced, and the width of the bezel of the display panel is reduced.

An embodiment of the present disclosure provides a display panel. The display panel includes a gate electrode driving circuit, and the gate electrode driving circuit includes:

a logical addressing unit connected to a first node to pull up electric potentials of the first node and a second node in a plurality of blank time periods;

a pull-up control module connected to the logical addressing unit and the first node and used for pulling up the electric potential of the first node at a plurality of display time periods;

a pull-up unit comprising the first node, a second node, and a low frequency control signal source, wherein the pull-up unit is connected to the pull-up control module and is used for pulling up electric potentials of a first stage transfer signal, a first output signal, and a second output signal;

a first drop-down unit connected to the first node and used for dropping down the electric potential of the first node at an end of the plurality of blank time periods;

a second drop-down unit connected to the first node and used for dropping down the electric potential of the first node at the plurality of display time periods;

a third drop-down unit connected to the second node and used for dropping down the electric potential of the second node at the plurality of display time periods;

a fourth drop-down unit connected to a third node and used for dropping down an electric potential of the third node at a start of the plurality of display time periods;

a first drop-down maintaining unit connected to the first node and used for maintaining a low electric potential of the first node;

a second drop-down maintaining unit used for maintaining low electric potentials of the first stage transfer signal, the first output signal, and the second output signal; and an inverter comprising the third node used for inverting the electric potentials of the first node and the third node.

In an embodiment, and in the display panel, the logical addressing unit includes a second stage transfer signal terminal, a first signal input terminal, a high electric potential input terminal, a reset signal terminal, a first transistor, a second transistor, a third transistor, a fourth transistor, a fifth transistor, and a first storage capacitor. A gate electrode of the first transistor is connected to the first signal input terminal. A first electrode of the first transistor is connected to the second stage transfer signal terminal. A second electrode of the first transistor is connected to a first electrode of the second transistor. The second electrode of the first transistor is connected to a second electrode of the third transistor. A gate electrode of the second electrode is connected to the first signal input terminal. A second electrode of the second transistor is connected to a first polar plate of the first storage capacitor. A first electrode of the third transistor is connected to the high electric potential input terminal. A gate electrode of the third transistor is connected to the first polar plate of the first storage capacitor. The high electric potential input terminal is connected to a second polar plate of the first storage capacitor. A gate electrode of the fourth transistor is connected to the first polar plate of the first storage capacitor. A first electrode of the fourth transistor is connected to the high electric potential input terminal. A second electrode of the fourth transistor is connected to a first electrode of the fifth transistor. A gate electrode of the fifth transistor is connected to the reset signal terminal. A second electrode of the fifth transistor is connected to the first node.

In an embodiment, and in the display panel, the pull-up control module includes the second stage transfer signal terminal, a fourth node, a sixth transistor, and a seventh transistor. A gate electrode and a first electrode of the sixth transistor are connected to the second stage transfer signal terminal, a second electrode of the sixth transistor is connected to the fourth node, a gate electrode of the seventh transistor is connected to the second stage transfer signal terminal, a first electrode of the seventh transistor is connected to the fourth node, and a second electrode of the seventh transistor is connected to the first node.

In an embodiment, and in the display panel, the gate electrode driving circuit includes a first stage transfer signal terminal, a first signal output terminal, and a second signal output terminal, and the pull-up unit includes a first clock signal terminal, a second clock signal terminal, a third storage capacitor, an eighth transistor, the fourth node, a second storage capacitor, a third storage capacitor, an eighth transistor, a ninth transistor, a tenth transistor, an eleventh transistor, and a twelfth transistor. A gate electrode of the eighth transistor is connected to the first clock signal terminal. A first electrode of the eighth transistor is connected to the first node. A second electrode of the eighth transistor is connected to a gate electrode of the ninth transistor. A first electrode of the ninth transistor is connected to the low frequency control signal source. A second electrode of the ninth transistor is connected to the first stage transfer signal terminal. A gate electrode of the tenth transistor is connected to the second node. A first electrode of the tenth transistor is connected to the first clock signal terminal. A second electrode of the tenth transistor is connected to the first signal output terminal. A gate electrode of the eleventh transistor is connected to the second node. A first electrode of the eleventh transistor is connected to the second clock signal terminal. A second electrode of the eleventh transistor is connected to the second signal output terminal. A gate electrode of the twelfth transistor is connected to the second node. A first electrode of the twelfth transistor is connected to the fourth node. A second electrode of the twelfth transistor is connected to the first signal output terminal. A first polar plate of the second storage capacitor is connected to the second node. A second polar plate of the second storage capacitor is connected to the first signal output terminal. A first polar plate of the third storage capacitor is connected to the second node. A second polar plate of the third storage capacitor is connected to the second signal output terminal.

In an embodiment, and in the display panel, the first drop-down unit includes a first low electric potential input terminal, a second signal input terminal, a thirteenth transistor, and a fourteenth transistor. A gate electrode of the thirteenth transistor is connected to the second signal input terminal, a first electrode of the thirteenth transistor is connected to a second electrode of the fourteenth transistor, a second electrode of the thirteenth transistor is connected to the first node, a gate electrode of the fourteenth transistor is connected to the second signal input terminal, and a first electrode of the fourteenth transistor is connected to the first low electric potential input terminal.

In an embodiment, and in the display panel, the second drop-down unit includes a third stage transfer signal terminal, the fourth node, a fifteenth transistor, and a sixteenth transistor. A gate electrode of the fifteenth transistor is connected to the third stage transfer signal terminal, a first electrode of the fifteenth transistor is connected to the fourth node, a second electrode of the fifth transistor is connected to the first node, a gate electrode of the sixteenth transistor is connected to the third stage transfer signal terminal, a first electrode of the sixteenth transistor is connected to the first low electric potential input terminal, and a second electrode of the sixteenth transistor is connected to the fourth node.

In an embodiment, and in the display panel, the third drop-down unit includes the third stage transfer signal terminal, the fourth node, a seventeenth transistor, and an eighteenth transistor. A gate electrode of the seventeenth transistor is connected to the third stage transfer signal terminal, a first electrode of the seventeenth transistor is connected to the fourth node, a second electrode of the seventeenth transistor is connected to the second node, a gate electrode of the eighteenth transistor is connected to the third stage transfer signal terminal, a first electrode of the eighteenth transistor is connected to the first low electric potential input terminal, and a second electrode of the eighteenth transistor is connected to the fourth node.

In an embodiment, and in the display panel, the fourth drop-down unit includes the first stage transfer signal terminal, the reset signal terminal, a fifth node, a nineteenth transistor, a twentieth transistor, and a twenty-first transistor, wherein a gate electrode of the nineteenth transistor is connected to the first stage transfer signal terminal, a first electrode of the nineteenth transistor is connected to a second low electric potential input terminal, a second electrode of the nineteenth transistor is connected to the third node, a gate electrode of the twentieth transistor is connected to the reset signal terminal, a first electrode of the twentieth transistor is connected to a second electrode of the twenty-first transistor, a gate electrode of the twenty-first transistor is connected to the fifth node, and a first electrode of the twenty-first transistor is connected to the second low electric potential input terminal.

In an embodiment, and in the display panel, the first drop-down maintaining unit includes the fourth node, a twenty-second transistor, and a twenty-third transistor, wherein a gate electrode of the twenty-second transistor is connected to the third node, a first electrode of the twenty-second transistor is connected to the fourth node, a second electrode of the twenty-second transistor is connected to the first node, a gate electrode of the twenty-third transistor is connected to the third node, a first electrode of the twenty-third transistor is connected to the first low electric potential input terminal, and a second electrode of the twenty-third transistor is connected to the fourth node.

In an embodiment, and in the display panel, the second drop-down maintaining unit includes a third low electric potential input terminal, a twenty-fourth transistor, a twenty-fifth transistor, and a twenty-sixth transistor, wherein a gate electrode of the twenty-fourth transistor is connected to the third node, a first electrode of the twenty-fourth transistor is connected to the first low electric potential input terminal, a second electrode of the twenty-fourth transistor is connected to the first stage transfer signal terminal, a gate electrode of the twenty-fifth transistor is connected to the third node, a first electrode of the twenty-fifth transistor is connected to the third low electric potential input terminal, a second electrode of the twenty-fifth transistor is connected to the first signal output terminal, a gate electrode of the twenty-sixth transistor is connected to the third node, a first electrode of the twenty-sixth transistor is connected to the third low electric potential input terminal, and a second electrode of the twenty-sixth transistor is connected to the second signal output terminal.

In an embodiment, and in the display panel, the inverter further includes the high electric potential input terminal, the second low electric potential input terminal, a twenty-seventh transistor, a twenty-eighth transistor, a twenty-ninth transistor, and a thirtieth transistor. A gate electrode and a first electrode of the twenty-seventh transistor are connected to the high electric potential input terminal. A second electrode of the twenty-seventh transistor is connected to a first electrode of the twenty-eighth transistor. A gate electrode of the twenty-eighth transistor is connected to the first node. A second electrode of the twenty-eighth transistor is connected to the second low electric potential input terminal. A gate electrode of the twenty-ninth transistor is connected to a second electrode of the twenty-seventh transistor. A first electrode of the twenty-ninth transistor is connected to the high electric potential input terminal. A second electrode of the twenty-ninth transistor is connected to the third node. A gate electrode of the thirtieth transistor is connected to the first node. A first electrode of the thirtieth transistor is connected to the second low electric potential input terminal. A second electrode of the thirtieth transistor is connected to the third node.

According to embodiments mentioned above, it can be understood:

embodiments of the present disclosure provide a gate electrode driving circuit and a display panel. The gate electrode driving circuit includes a logical addressing unit, a pull-up control module, a pull-up unit, a first drop-down unit, a second drop-down unit, a third drop-down unit, a fourth drop-down unit, a first drop-down maintaining unit, a second drop-down maintaining unit, and an inverter. The logical addressing unit is connected to a first node to pull up electric potentials of the first node and a second node in a plurality of blank time periods. The pull-up control module is connected to the logical addressing unit and the first node and is used for pulling up the electric potential of the first node at a plurality of display time periods. The pull-up unit includes the first node, a second node, and a low frequency control signal source. The pull-up unit is connected to the pull-up control module and is used for pulling up electric potentials of a first stage transfer signal, a first output signal, and a second output signal. The first drop-down unit is connected to the first node and is used for dropping down the electric potential of the first node at an end of the plurality of blank time periods. The second drop-down unit is connected to the first node and is used for dropping down the electric potential of the first node at the plurality of display time periods. The third drop-down unit is connected to the second node and is used for dropping down the electric potential of the second node at the plurality of display time periods. The fourth drop-down unit is connected to a third node and used for dropping down an electric potential of the third node at a start of the plurality of display time periods. The first drop-down maintaining unit is connected to the first node and is used for maintaining a low electric potential of the first node. The second drop-down maintaining unit is used for maintaining low electric potentials of the first stage transfer signal, the first output signal, and the second output signal. The inverter includes the third node used for inverting the electric potentials of the first node and the third node. By disposing the low frequency control signal source and the third drop-down unit in the gate electrode driving circuit, making the third drop-down unit regulate the electric potential at the second node in the circuits, allowing the corresponding low frequency control signal source to output signals to the first stage transfer signal terminal, and making the low frequency control signal source and the third drop-down unit replace one group of the clock signal, because the low frequency control signal source and the third drop-down unit occupy less space, a width of the gate electrode driving circuit is reduced, thereby reducing a bezel of the display panel, and easing the technical problem of a large number of the clock signal lines causing the larger bezels of the display panels.

It can be understood, that for those of ordinary skill in the art, various other corresponding changes and modifications can be made according to the technical solutions and technical ideas of the present disclosure, and all such changes and modifications are intended to fall within the scope of protection of the claims of the present disclosure.

What is claimed is:

1. A gate electrode driving circuit, comprising:

a logical addressing unit connected to a first node to pull up electric potentials of the first node and a second node in a plurality of blank time periods;

a pull-up control module connected to the logical addressing unit and the first node and used for pulling up the electric potential of the first node at a plurality of display time periods;

a pull-up unit comprising the first node, the second node, and a low frequency control signal source, wherein the pull-up unit is connected to the pull-up control module and is used for pulling up electric potentials of a first stage transfer signal, a first output signal, and a second output signal;

a first drop-down unit connected to the first node and used for dropping down the electric potential of the first node at an end of the plurality of blank time periods;

a second drop-down unit connected to the first node and used for dropping down the electric potential of the first node at the plurality of display time periods;

a third drop-down unit connected to the second node and used for dropping down the electric potential of the second node at the plurality of display time periods;

a fourth drop-down unit connected to a third node and used for dropping down an electric potential of the third node at a start of the plurality of display time periods;

a first drop-down maintaining unit connected to the first node and used for maintaining a low electric potential of the first node;

a second drop-down maintaining unit used for maintaining low electric potentials of the first stage transfer signal, the first output signal, and the second output signal;

and an inverter comprising the third node used for inverting the electric potentials of the first node and the third node.

2. The gate electrode driving circuit as claimed in claim 1, wherein the logical addressing unit comprises a second stage transfer signal terminal, a first signal input terminal, a high electric potential input terminal, a reset signal terminal, a first transistor, a second transistor, a third transistor, a fourth transistor, a fifth transistor, and a first storage capacitor, wherein a gate electrode of the first transistor is connected to the first signal input terminal, a first electrode of the first transistor is connected to the second stage transfer signal terminal, a second electrode of the first transistor is connected to a first electrode of the second transistor, the second electrode of the first transistor is connected to a second electrode of the third transistor, a gate electrode of the second transistor is connected to the first signal input terminal, a second electrode of the second transistor is connected to a first polar plate of the first storage capacitor, a first electrode of the third transistor is connected to the high electric potential input terminal, a gate electrode of the third transistor is connected to the first polar plate of the first storage capacitor, the high electric potential input terminal is connected to a second polar plate of the first storage capacitor, a gate electrode of the fourth transistor is connected to the first polar plate of the first storage capacitor, a first electrode of the fourth transistor is connected to the high electric potential input terminal, a second electrode of the fourth transistor is connected to a first electrode of the fifth transistor, a gate electrode of the fifth transistor is connected to the reset signal terminal, and a second electrode of the fifth transistor is connected to the first node.

3. The gate electrode driving circuit as claimed in claim 2, wherein the pull-up control module comprises the second stage transfer signal terminal, a fourth node, a sixth transistor, and a seventh transistor, wherein a gate electrode and a first electrode of the sixth transistor are connected to the second stage transfer signal terminal, a second electrode of the sixth transistor is connected to the fourth node, a gate electrode of the seventh transistor is connected to the second stage transfer signal terminal, a first electrode of the seventh transistor is connected to the fourth node, and a second electrode of the seventh transistor is connected to the first node.

4. The gate electrode driving circuit as claimed in claim 3, wherein the gate electrode driving circuit comprises a first stage transfer signal terminal, a first signal output terminal, and a second signal output terminal, and the pull-up unit comprises a first clock signal terminal, a second clock signal terminal, the fourth node, a second storage capacitor, a third storage capacitor, an eighth transistor, a ninth transistor, a tenth transistor, an eleventh transistor, and a twelfth transistor, a gate electrode of the eighth transistor is connected to the first clock signal terminal, a first electrode of the eighth transistor is connected to the first node, a second electrode of the eighth transistor is connected to a gate electrode of the ninth transistor, a first electrode of the ninth transistor is connected to the low frequency control signal source, a second electrode of the ninth transistor is connected to the first stage transfer signal terminal, a gate electrode of the tenth transistor is connected to the second node, a first electrode of the tenth transistor is connected to the first clock signal terminal, a second electrode of the tenth transistor is connected to the first signal output terminal, a gate electrode of the eleventh transistor is connected to the second node, a first electrode of the eleventh transistor is connected to the second clock signal terminal, a second electrode of the eleventh transistor is connected to the second signal output terminal, a gate electrode of the twelfth transistor is connected to the second node, a first electrode of the twelfth transistor is connected to the fourth node, a second electrode of the twelfth transistor is connected to the first signal output terminal, a first polar plate of the second storage capacitor is connected to the second node, a second polar plate of the second storage capacitor is connected to the first signal output terminal, a first polar plate of the third storage capacitor is connected to the second node, and a second polar plate of the third storage capacitor is connected to the second signal output terminal.

5. The gate electrode driving circuit as claimed in claim 4, wherein the first drop-down unit comprises a first low electric potential input terminal, a second signal input terminal, a thirteenth transistor, and a fourteenth transistor, wherein a gate electrode of the thirteenth transistor is connected to the second signal input terminal, a first electrode of the thirteenth transistor is connected to a second electrode of the fourteenth transistor, a second electrode of the thirteenth transistor is connected to the first node, a gate electrode of the fourteenth transistor is connected to the second signal input terminal, and a first electrode of the fourteenth transistor is connected to the first low electric potential input terminal.

6. The gate electrode driving circuit as claimed in claim 5, wherein the second drop-down unit comprises a third stage transfer signal terminal, the fourth node, a fifteenth transistor, and a sixteenth transistor, wherein a gate electrode of the fifteenth transistor is connected to the third stage transfer signal terminal, a first electrode of the fifteenth transistor is connected to the fourth node, a second electrode of the fifth transistor is connected to the first node, a gate electrode of the sixteenth transistor is connected to the third stage transfer signal terminal, a first electrode of the sixteenth transistor is connected to the first low electric potential input terminal, and a second electrode of the sixteenth transistor is connected to the fourth node.

7. The gate electrode driving circuit as claimed in claim 6, wherein the third drop-down unit comprises the third stage transfer signal terminal, the fourth node, a seventeenth transistor, and an eighteenth transistor, wherein a gate electrode of the seventeenth transistor is connected to the third stage transfer signal terminal, a first electrode of the seventeenth transistor is connected to the fourth node, a second electrode of the seventeenth transistor is connected to the second node, a gate electrode of the eighteenth transistor is connected to the third stage transfer signal terminal, a first electrode of the eighteenth transistor is connected to the first low electric potential input terminal, and a second electrode of the eighteenth transistor is connected to the fourth node.

8. The gate electrode driving circuit as claimed in claim 7, wherein the fourth drop-down unit comprises the first stage transfer signal terminal, the reset signal terminal, a fifth node, a nineteenth transistor, a twentieth transistor, and a twenty-first transistor, wherein a gate electrode of the nineteenth transistor is connected to the first stage transfer signal terminal, a first electrode of the nineteenth transistor is connected to a second low electric potential input terminal, a second electrode of the nineteenth transistor is connected to the third node, a gate electrode of the twentieth transistor is connected to the reset signal terminal, a first electrode of the twentieth transistor is connected to a second electrode of the twenty-first transistor, a gate electrode of the twenty-first transistor is connected to the fifth node, and a first electrode of the twenty-first transistor is connected to the second low electric potential input terminal.

9. The gate electrode driving circuit as claimed in claim 8, wherein the first drop-down maintaining unit comprises the fourth node, a twenty-second transistor, and a twenty-third transistor, wherein a gate electrode of the twenty-second transistor is connected to the third node, a first electrode of the twenty-second transistor is connected to the fourth node, a second electrode of the twenty-second transistor is connected to the first node, a gate electrode of the twenty-third transistor is connected to the third node, a first electrode of the twenty-third transistor is connected to the first low electric potential input terminal, and a second electrode of the twenty-third transistor is connected to the fourth node.

10. A display panel, comprising a gate electrode driving circuit, wherein the gate electrode driving circuit comprises:

a logical addressing unit connected to a first node to pull up electric potentials of the first node and a second node in a plurality of blank time periods;

a pull-up control module connected to the logical addressing unit and the first node and used for pulling up the electric potential of the first node at a plurality of display time periods;

a pull-up unit comprising the first node, the second node, and a low frequency control signal source, wherein the pull-up unit is connected to the pull-up control module and is used for pulling up electric potentials of a first stage transfer signal, a first output signal, and a second output signal;

a first drop-down unit connected to the first node and used for dropping down the electric potential of the first node at an end of the plurality of blank time periods;

a second drop-down unit connected to the first node and used for dropping down the electric potential of the first node at the plurality of display time periods;

a third drop-down unit connected to the second node and used for dropping down the electric potential of the second node at the plurality of display time periods;

a fourth drop-down unit connected to a third node and used for dropping down an electric potential of the third node at a start of the plurality of display time periods;

a first drop-down maintaining unit connected to the first node and used for maintaining a low electric potential of the first node;

a second drop-down maintaining unit used for maintaining low electric potentials of the first stage transfer signal, the first output signal, and the second output signal;

and an inverter comprising the third node used for inverting the electric potentials of the first node and the third node.

11. The display panel as claimed in claim 10, wherein the logical addressing unit comprises a second stage transfer signal terminal, a first signal input terminal, a high electric potential input terminal, a reset signal terminal, a first transistor, a second transistor, a third transistor, a fourth transistor, a fifth transistor, and a first storage capacitor, wherein a gate electrode of the first transistor is connected to the first signal input terminal, a first electrode of the first transistor is connected to the second stage transfer signal terminal, a second electrode of the first transistor is connected to a first electrode of the second transistor, the second electrode of the first transistor is connected to a second electrode of the third transistor, a gate electrode of the second transistor is connected to the first signal input terminal, a second electrode of the second transistor is connected to a first polar plate of the first storage capacitor, a first electrode of the third transistor is connected to the high electric potential input terminal, a gate electrode of the third transistor is connected to the first polar plate of the first storage capacitor, the high electric potential input terminal is connected to a second polar plate of the first storage capacitor, a gate electrode of the fourth transistor is connected to the first polar plate of the first storage capacitor, a first electrode of the fourth transistor is connected to the high electric potential input terminal, a second electrode of the fourth transistor is connected to a first electrode of the fifth transistor, a gate electrode of the fifth transistor is connected to the reset signal terminal, and a second electrode of the fifth transistor is connected to the first node.

12. The display panel as claimed in claim 11, wherein the pull-up control module comprises the second stage transfer signal terminal, a fourth node, a sixth transistor, a seventh transistor, wherein a gate electrode and a first electrode of the sixth transistor are connected to the second stage transfer signal terminal, a second electrode of the sixth transistor is connected to the fourth node, a gate electrode of the seventh transistor is connected to the second stage transfer signal terminal, a first electrode of the seventh transistor is connected to the fourth node, and a second electrode of the seventh transistor is connected to the first node.

13. The display panel as claimed in claim 12, wherein the display panel comprises a first stage transfer signal terminal, a first signal output terminal, and a second signal output terminal, and the pull-up unit comprises a first clock signal terminal, a second clock signal terminal, the fourth node, a second storage capacitor, a third storage capacitor, an eighth transistor, a ninth transistor, a tenth transistor, an eleventh transistor, and a twelfth transistor, a gate electrode of the eighth transistor is connected to the first clock signal terminal, a first electrode of the eighth transistor is connected to the first node, a second electrode of the eighth transistor is connected to a gate electrode of the ninth transistor, a first electrode of the ninth transistor is connected to the low frequency control signal source, a second electrode of the ninth transistor is connected to the first stage transfer signal terminal, a gate electrode of the tenth transistor is connected to the second node, a first electrode of the tenth transistor is connected to the first clock signal terminal, a second electrode of the tenth transistor is connected to the first signal output terminal, a gate electrode of the eleventh transistor is connected to the second node, a first electrode of the eleventh transistor is connected to the second clock signal terminal, a second electrode of the eleventh transistor is connected to the second signal output terminal, a gate electrode of the twelfth transistor is connected to the second node, a first electrode of the twelfth transistor is connected to the fourth node, a second electrode of the twelfth transistor is connected to the first signal output terminal, a first polar plate of the second storage capacitor is connected to the second node, a second polar plate of the second storage capacitor is connected to the first signal output terminal, a first polar plate of the third storage capacitor is connected to the second node, and a second polar plate of the third storage capacitor is connected to the second signal output terminal.

14. The display panel as claimed in claim 13, wherein the first drop-down unit comprises a first low electric potential input terminal, a second signal input terminal, a thirteenth transistor, and a fourteenth transistor, wherein a gate electrode of the thirteenth transistor is connected to the second signal input terminal, a first electrode of the thirteenth transistor is connected to a second electrode of the fourteenth transistor, a second electrode of the thirteenth transistor is connected to the first node, a gate electrode of the fourteenth transistor is connected to the second signal input terminal, and a first electrode of the fourteenth transistor is connected to the first low electric potential input terminal.

15. The display panel as claimed in claim 14, wherein the second drop-down unit comprises a third stage transfer signal terminal, the fourth node, a fifteenth transistor, and a sixteenth transistor, wherein a gate electrode of the fifteenth transistor is connected to the third stage transfer signal terminal, a first electrode of the fifteenth transistor is connected to the fourth node, a second electrode of the fifth transistor is connected to the first node, a gate electrode of the sixteenth transistor is connected to the third stage transfer signal terminal, a first electrode of the sixteenth transistor is connected to the first low electric potential input terminal, and a second electrode of the sixteenth transistor is connected to the fourth node.

16. The display panel as claimed in claim 15, wherein the third drop-down unit comprises the third stage transfer signal terminal, the fourth node, a seventeenth transistor, and an eighteenth transistor, wherein a gate electrode of the seventeenth transistor is connected to the third stage transfer signal terminal, a first electrode of the seventeenth transistor is connected to the fourth node, a second electrode of the seventeenth transistor is connected to the second node, a gate electrode of the eighteenth transistor is connected to the third stage transfer signal terminal, a first electrode of the eighteenth transistor is connected to the first low electric potential input terminal, and a second electrode of the eighteenth transistor is connected to the fourth node.

17. The display panel as claimed in claim 16, wherein the fourth drop-down unit comprises the first stage transfer signal terminal, the reset signal terminal, a fifth node, a nineteenth transistor, a twentieth transistor, and a twenty-first transistor, wherein a gate electrode of the nineteenth transistor is connected to the first stage transfer signal terminal, a first electrode of the nineteenth transistor is connected to a second low electric potential input terminal, a second electrode of the nineteenth transistor is connected to the third node, a gate electrode of the twentieth transistor is connected to the reset signal terminal, a first electrode of the twentieth transistor is connected to a second electrode of the twenty-first transistor, a gate electrode of the twenty-first transistor is connected to the fifth node, and a first electrode of the twenty-first transistor is connected to the second low electric potential input terminal.

18. The display panel as claimed in claim 17, wherein the first drop-down maintaining unit comprises the fourth node, a twenty-second transistor, and a twenty-third transistor, wherein a gate electrode of the twenty-second transistor is connected to the third node, a first electrode of the twenty-second transistor is connected to the fourth node, a second electrode of the twenty-second transistor is connected to the first node, a gate electrode of the twenty-third transistor is connected to the third node, a first electrode of the twenty-third transistor is connected to the first low electric potential input terminal, and a second electrode of the twenty-third transistor is connected to the fourth node.

19. The display panel as claimed in claim 18, wherein the second drop-down maintaining unit comprises a third low electric potential input terminal, a twenty-fourth transistor, a twenty-fifth transistor, and a twenty-sixth transistor, wherein a gate electrode of the twenty-fourth transistor is connected to the third node, a first electrode of the twenty-fourth transistor is connected to the first low electric potential input terminal, a second electrode of the twenty-fourth transistor is connected to the first stage transfer signal terminal, a gate electrode of the twenty-fifth transistor is connected to the third node, a first electrode of the twenty-fifth transistor is connected to the third low electric potential input terminal, a second electrode of the twenty-fifth transistor is connected to the first signal output terminal, a gate electrode of the twenty-sixth transistor is connected to the third node, a first electrode of the twenty-sixth transistor is connected to the third low electric potential input terminal, and a second electrode of the twenty-sixth transistor is connected to the second signal output terminal.

20. The display panel as claimed in claim 19, wherein the inverter further comprises the high electric potential input terminal, the second low electric potential input terminal, a twenty-seventh transistor, a twenty-eighth transistor, a twenty-ninth transistor, and a thirtieth transistor, wherein a gate electrode and a first electrode of the twenty-seventh transistor are connected to the high electric potential input terminal, a second electrode of the twenty-seventh transistor is connected to a first electrode of the twenty-eighth transistor, a gate electrode of the twenty-eighth transistor is connected to the first node, a second electrode of the twenty-eighth transistor is connected to the second low electric potential input terminal, a gate electrode of the twenty-ninth transistor is connected to a second electrode of the twenty-seventh transistor, a first electrode of the twenty-ninth transistor is connected to the high electric potential input terminal, a second electrode of the twenty-ninth transistor is connected to the third node, a gate electrode of the thirtieth transistor is connected to the first node, a first electrode of the thirtieth transistor is connected to the second low electric potential input terminal, and a second electrode of the thirtieth transistor is connected to the third node.

* * * * *